US011679042B2

(12) United States Patent
Fanelli et al.

(10) Patent No.: US 11,679,042 B2
(45) Date of Patent: Jun. 20, 2023

(54) LITTER WITH CURVED FEET FOR EASY LOADING

(71) Applicant: Romeo Six LLC, Holly Springs, NC (US)

(72) Inventors: Joseph Andrew Fanelli, Cameron, NC (US); William Bryan Carr, Apex, NC (US)

(73) Assignee: Romeo Six LLC, Holly Springs, NC (US)

( * ) Notice: Subject to any disclaimer, the term of this patent is extended or adjusted under 35 U.S.C. 154(b) by 0 days.

(21) Appl. No.: 17/521,965

(22) Filed: Nov. 9, 2021

(65) Prior Publication Data

US 2023/0143561 A1 May 11, 2023

(51) Int. Cl.
*A61G 1/04* (2006.01)
*A61G 1/01* (2006.01)

(52) U.S. Cl.
CPC ..... *A61G 1/04* (2013.01); *A61G 1/01* (2013.01)

(58) Field of Classification Search
CPC ..... A61G 1/04; A61G 1/01
See application file for complete search history.

(56) References Cited

U.S. PATENT DOCUMENTS 749,731 A * 1/1904 Hall ..... A61G 1/04 297/440.22
2,745,114 A * 5/1956 Cote ..... A61G 1/013 5/116
3,176,321 A 4/1965 Conrad
3,597,773 A 8/1971 Firestone
5,598,592 A 2/1997 Castellani
6,842,923 B1 1/2005 Castellani et al.
8,104,124 B2 1/2012 Awerbuch et al.
8,127,381 B2 3/2012 Westmoreland, II et al.
10,154,930 B2 * 12/2018 Heneveld, Jr. ..... A61G 1/003
10,881,559 B2 1/2021 Anderson
2010/0176619 A1 7/2010 Cahaan
2011/0099717 A1 5/2011 Windauer
2016/0022515 A1 * 1/2016 MacDonald ..... A61G 3/0858 5/625

FOREIGN PATENT DOCUMENTS

CN 109998843 A * 7/2019 ..... A61G 1/013

* cited by examiner

*Primary Examiner* — Robert G Santos
*Assistant Examiner* — Adam C Ortiz
(74) *Attorney, Agent, or Firm* — Nelson Mullins Riley & Scarborough LLP

(57) ABSTRACT

A litter for carrying an injured person and method of making the same is provided. The litter comprises a pair of frame rails defining a middle space therebetween. A carrying structure is supported by the pair of frame rails in the middle space and defines a top surface and a bottom surface. The carrying structure is configured to support an injured person on the top surface. The litter further comprises at least one spreader bar disposed between the pair of frame rails. At least one foot defining a top and a bottom may be attached to a bottom side of either the at least one spreader bar or at least one of the pair of frame rails. The at least one foot defines a curved surface leading downwardly from the top to the bottom vertically away from the top surface of the carrying structure and horizontally towards the middle space.

17 Claims, 26 Drawing Sheets

LITTER WITH CURVED FEET FOR EASY LOADING

FIELD OF THE INVENTION

Embodiments of the present invention relate generally to litters, stretchers, and the like, and more particularly, to litter feet having a curved surface providing for a smooth rotation between a loading position and a flat (e.g., ground) position.

BACKGROUND OF THE INVENTION

During combat when a soldier is injured, other soldiers may need to take the injured member of their company, platoon, or battalion etc. to receive medical treatment. Generally, the medical facilities may not be readily available or local, and there exists a need to reliably transport the injured person from the place of injury to a treatment facility.

When transporting an injured person, especially one with a head, neck, or spine injury, it is important for the injured person to remain as stationary as possible and to avoid sudden or jerky movements, as to not further the severity of the injury. When placing an injured person onto a litter or stretcher they may be lifted or maneuvered, increasing the likelihood of contributing to the trauma, or worsening the injury.

There exists a need for a lightweight litter with maneuverability about the feet to allow for easy and smooth loading, reliable transportation, and weight efficiency that is effective in any and all medical and military situations.

BRIEF SUMMARY OF THE INVENTION

The present disclosure addresses the above noted needs through various example litters described herein, including, for example, a collapsible litter that is compact, lightweight, and yet rigid and sturdy in the extended position. Furthermore, litters of the present disclosure can be maneuvered smoothly between a loading position and a flat position to easily place and receive an injured person on the litter.

As noted above, various situations require a person to be lifted off of the ground and carried somewhere, such as to a treatment facility. Litters are designed to transport an injured or wounded person between the injury site and either transportation vehicle, or the treatment site. However, as presently designed, litters do not afford a smooth transition for the injured person between the ground (e.g., at the injury site) and placement on the litter, where they may be treated or easily and safely maneuvered to a secondary location.

Example embodiments of the present invention provide an improvement on such litters. In an example embodiment, a litter has a pair of frame rails, which are supported by collapsible spreader bars. The litter may further include a carrying structure disposed between the frame rails and configured to support the injured person. In some embodiments, the litter may include at least one and up to four feet affixed to the spreader bars. The feet may be configured to have a curved surface between the connection point and the bottom, to allow the frame rails to rotate along the curved surface between a loading position and a flat position to provide a smooth loading for the injured person. In some embodiments, the litter may be telescoping and collapsible for easy carrying when collapsed, such as within or attached to a backpack.

In an example embodiment, a litter for carrying an injured person is provided. The litter may comprise a pair of frame rails defining a middle space therebetween, and a carrying structure supported by the pair of frame rails within the middle space and defining a top surface and a bottom surface. The carrying structure may be configured to support the injured person on the top surface. The litter may further include at least one spreader bar disposed between the pair of frame rails. Additionally, the litter may comprise at least one foot defining a top and a bottom. The top of the at least one foot may be attached to a bottom side of at least one of the at least one spreader bar or at least one of the pair of frame rails. The at least one foot may define a curved surface leading downwardly from the top to the bottom vertically away from the top surface of the carrying structure and horizontally toward the middle space.

In some embodiments, each of the pair of frame rails may define an exterior side and an internal side. The internal side of each of the pair of frame rails may face the middle space, and the exterior side of each of the pair of frame rails may be opposite the internal side. The curved surface may lead downwardly from a contact point with the at least one spreader bar or at least one of the pair of frame rails, and the contact point may vertically align with the exterior side of one of the pair of frame rails.

In some embodiments, each of the pair of frame rails extends along a longitudinal direction. The at least one foot may define a cross-section in a cross-sectional plane perpendicular to the longitudinal direction. The cross-section may define a perimeter extending, at least, from an exterior contact point with the at least one spreader bar or at least one of the pair of frame rails to an internal contact point with the at least one spreader bar or at least one of the pair of frame rails. The perimeter may include an apex point and may be curved from the exterior contact point to the apex point.

In some embodiments, the at least one foot further defines an attachment surface. The attachment surface may extend along the spreader bar between the exterior contact point and the internal contact point. In some embodiments, the attachment surface may be affixed to the spreader bar.

In some embodiments, the apex point is spaced apart from a center point of the at least one foot that is along the spreader bar between the exterior contact point and the internal contact point. In some embodiments, a plane extending between the center point and the apex point may define an angle with the spreader bar that is greater than 5 degrees and less than 120 degrees.

In some embodiments, the perimeter may comprise an exterior portion extending from the exterior contact point to the apex point and an interior portion extending from the internal contact point to the apex point. In some embodiments the internal portion may be linear.

In some embodiments, the apex point is a first apex point and the perimeter may comprise a second apex point. The perimeter may be curved from the first contact point to the first apex point, the perimeter may be linear between the first apex point and the second apex point.

In some embodiments, the perimeter may be curved between the second contact point and the second apex point.

In some embodiments, the feet may be attachable at a plurality of points along the length of the spreader bar.

In some embodiments, each of the pair of frame rails may comprise at least two telescoping rods hingedly connected.

In some embodiments, each of the telescoping rods may comprise an attachment feature opposite a hinge. The attachment feature may be configured to retain the telescoping rod in an extended position.

In some embodiments, each of the at least two telescoping rods may be primary telescoping rods. The primary telescoping rods may telescopingly receive a secondary telescoping rod, and each secondary telescoping rod may telescopingly receive a tertiary telescoping rod.

In some embodiments, the at least one spreader bar may have a first arm and a second arm hingedly connected. Each arm may be rotatably attached to a respective one of the pair of frame rails. Each arm may be configured to rotate about the frame rails between a collapsed position and an extended position.

In some embodiments, the at least one foot may be a first foot and a second foot. The first foot may be attached to the first arm and the second foot may be attached to the second arm.

In some embodiments, the litter may be constructed from carbon fiber. In some embodiments, the litter may be made from carbon fiber and aluminum. In some embodiments, the carrying structure may comprise a fabric secured between the pair of frame rails.

In another example embodiment, a foot for attachment on a frame for a litter is provided. The foot may comprise a body. The body may define a top and a bottom and may further define a curved surface extending from the top to the bottom. The body may define a cross-section in a cross-sectional plane. The cross-section may define a perimeter extending, at least, from an edge of the top to the bottom along the curved surface. The perimeter may further define an apex point spaced vertically away from the top. The perimeter may be curved from the edge of the top to the apex point. The top may include at least one mounting feature configured to enable mounting of the body of the foot to the frame of the litter.

In some embodiments, the perimeter may include a second apex point. The second apex point may be spaced horizontally apart from the first apex point. The bottom of the foot may be planar between the first apex point and the second apex point In yet another example embodiment, a method of manufacturing a litter is provided. The method comprises forming a first and second frame rail. The method may include attaching at least one spreader bar in a middle space between the first frame rail and the second frame rail. The method may further include attaching a first foot to the at least one spreader bar vertically aligned with the first frame rail. The first foot may define a top and a bottom, and the top of the first foot may be attached to a bottom side of the at least one spreader bar. The first foot may define a curved surface leading downwardly from the top to the bottom and horizontally toward the middle space. The method may include attaching a second foot to the at least one spreader bar vertically aligned with the second frame rail. The second foot may define a top and a bottom, and the top of the second foot may be attached to the bottom side of the at least one spreader bar. The second foot may define a curved surface leading downwardly from the top to the bottom and horizontally toward the middle space. The method may further include affixing a carrying structure to each of the first frame rail and the second frame rail. The carrying structure may be configured to support a person thereon.

BRIEF DESCRIPTION OF THE DRAWINGS

Figure 1A:
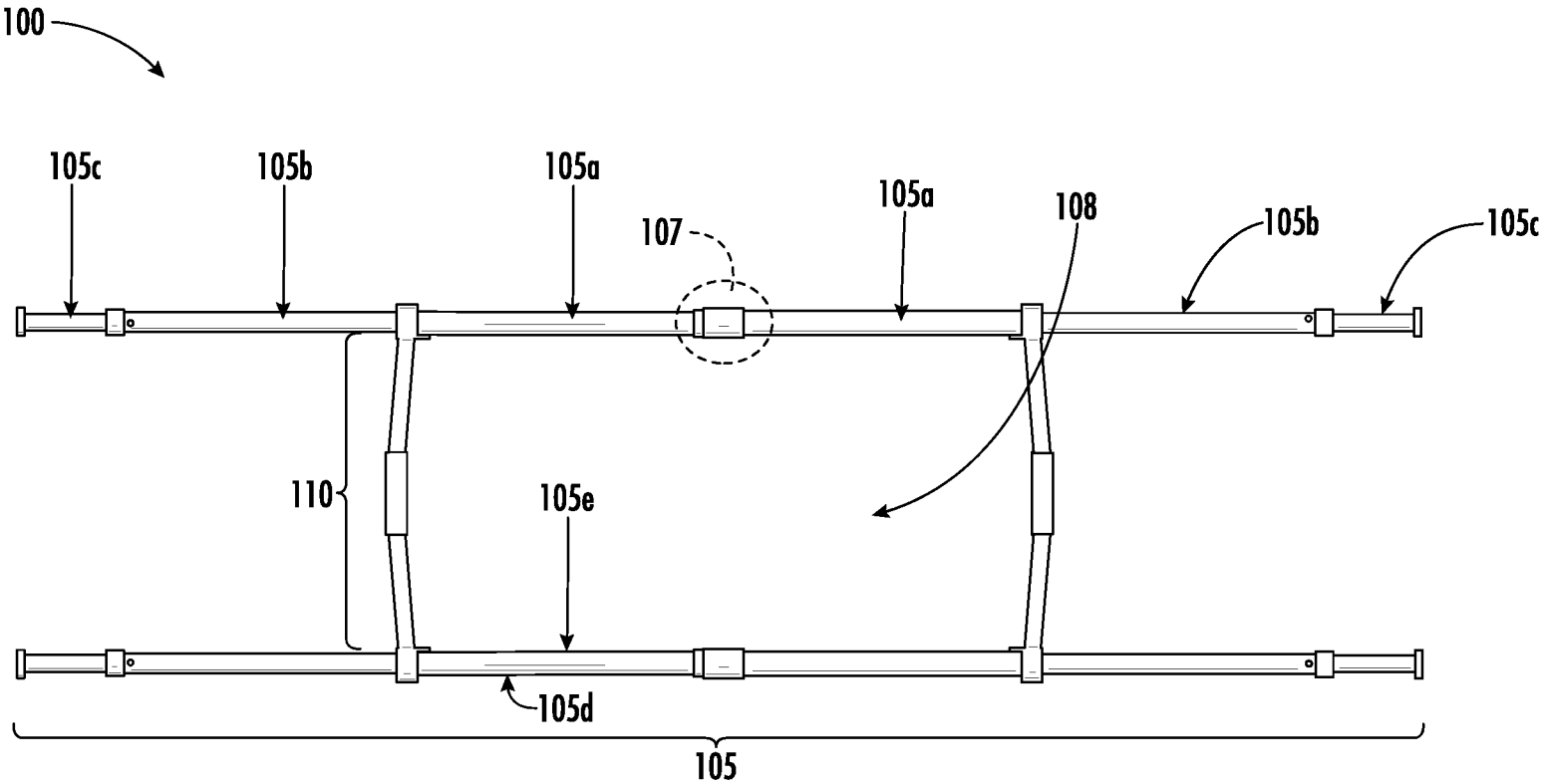
Figure 1B:
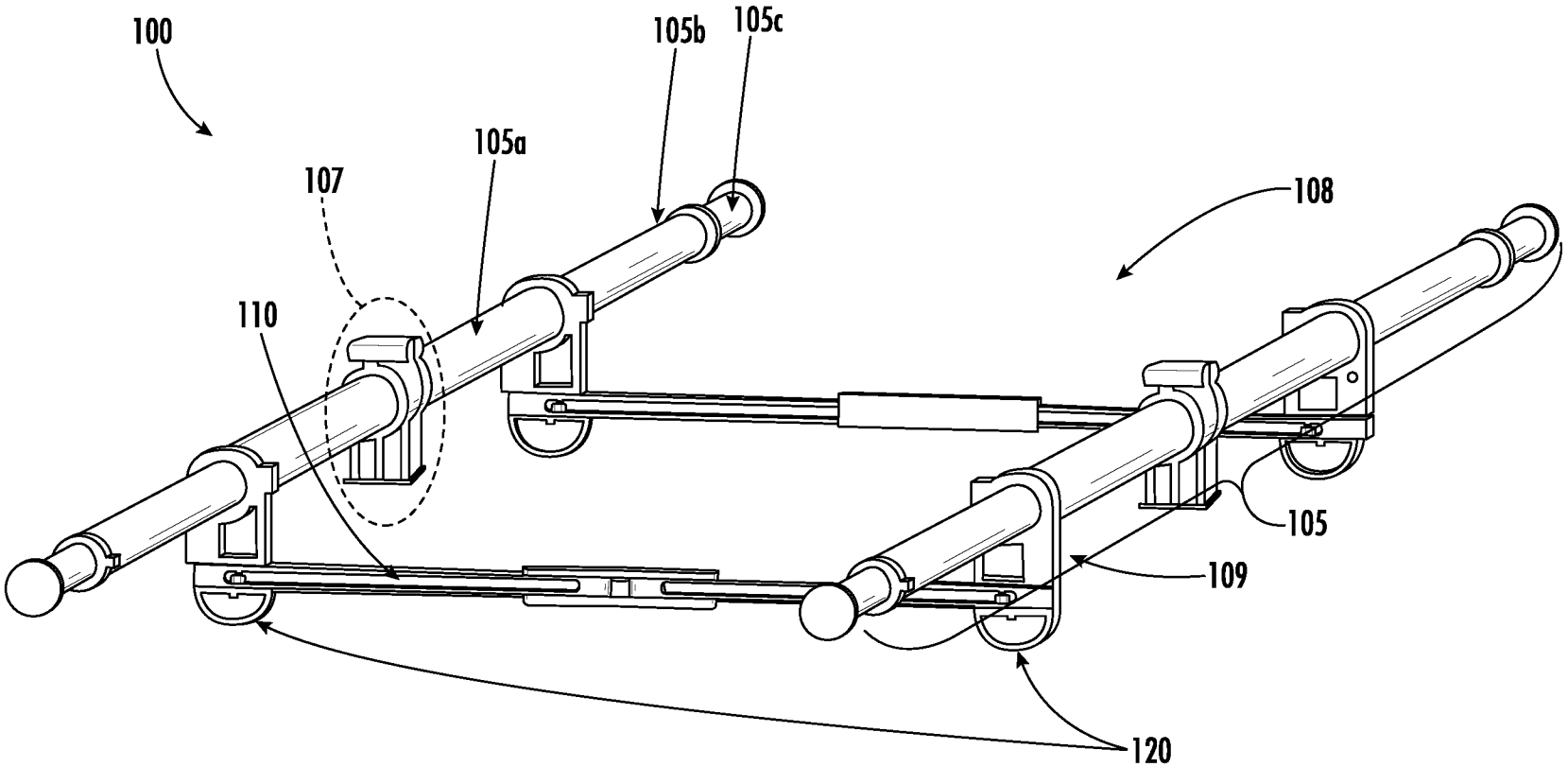
Figure 1C:
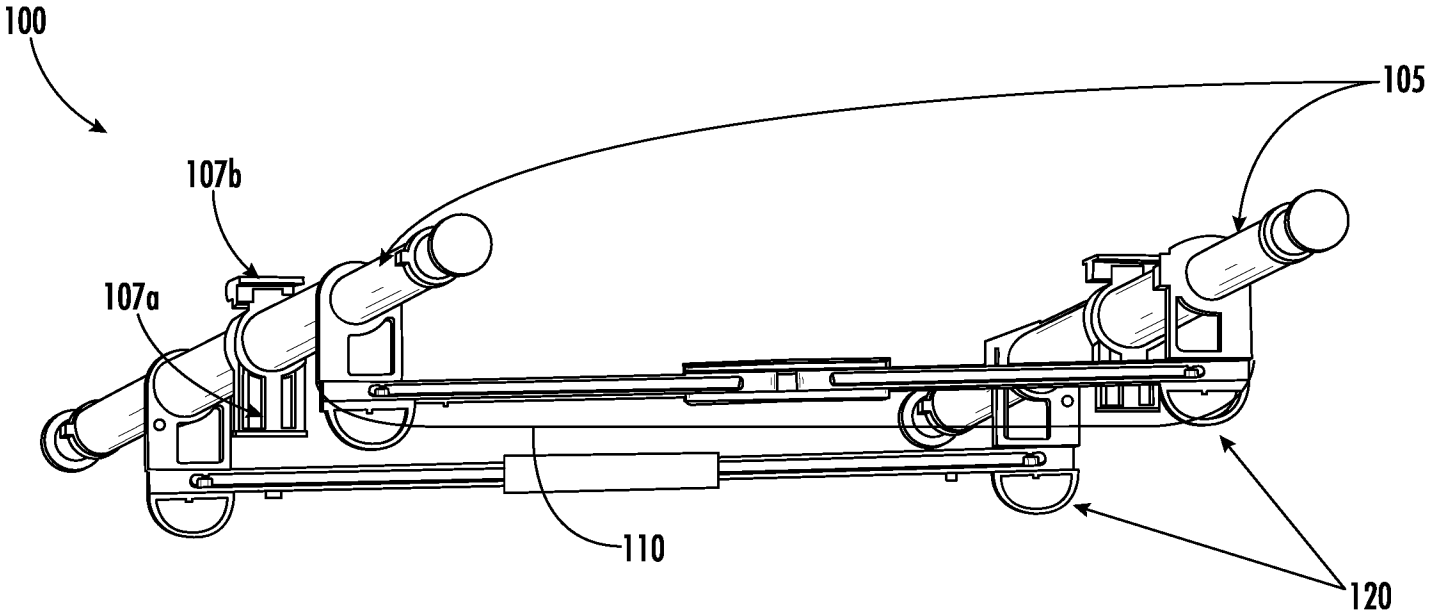
Figure 1D:
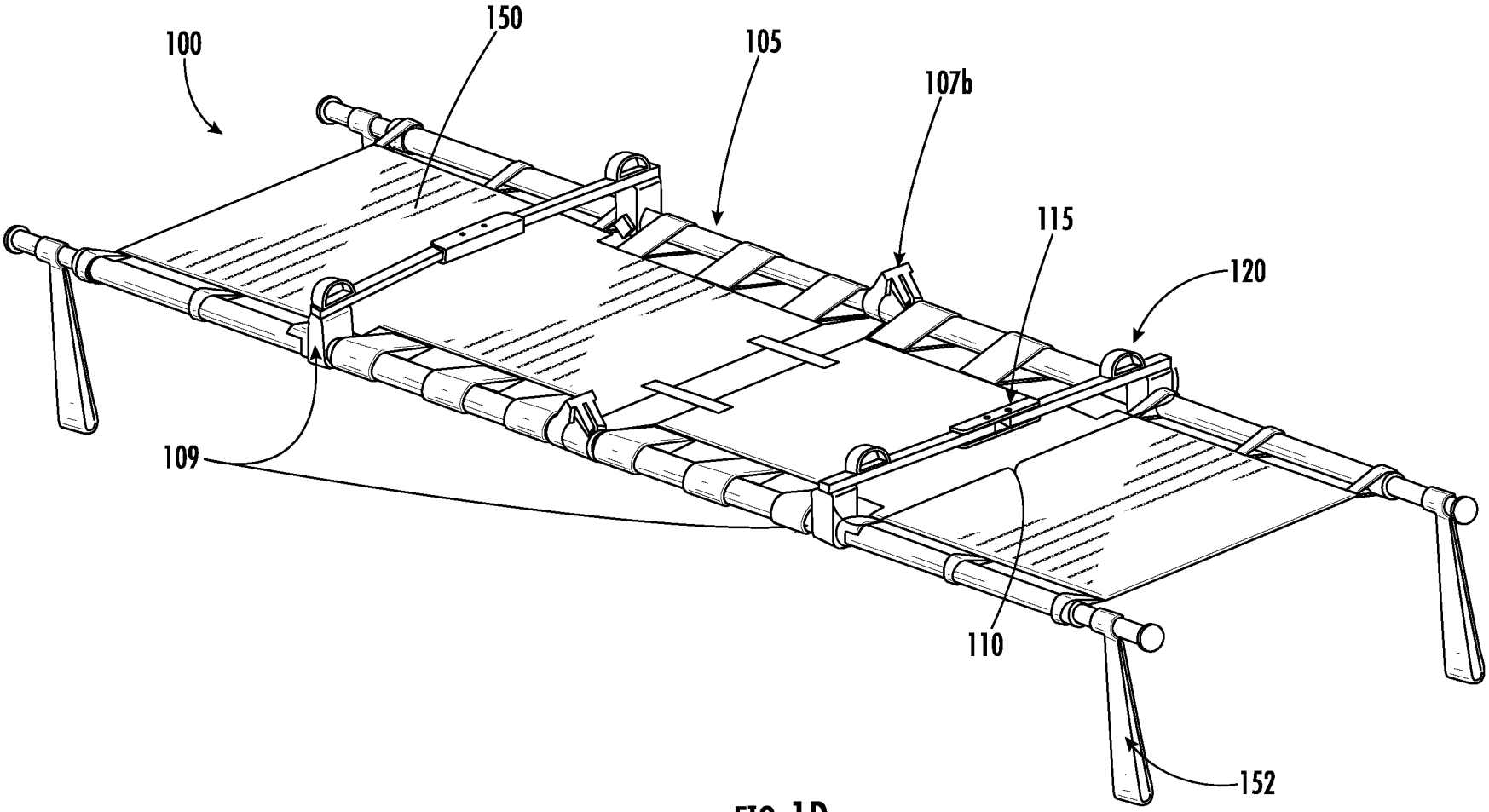
Figure 2A:
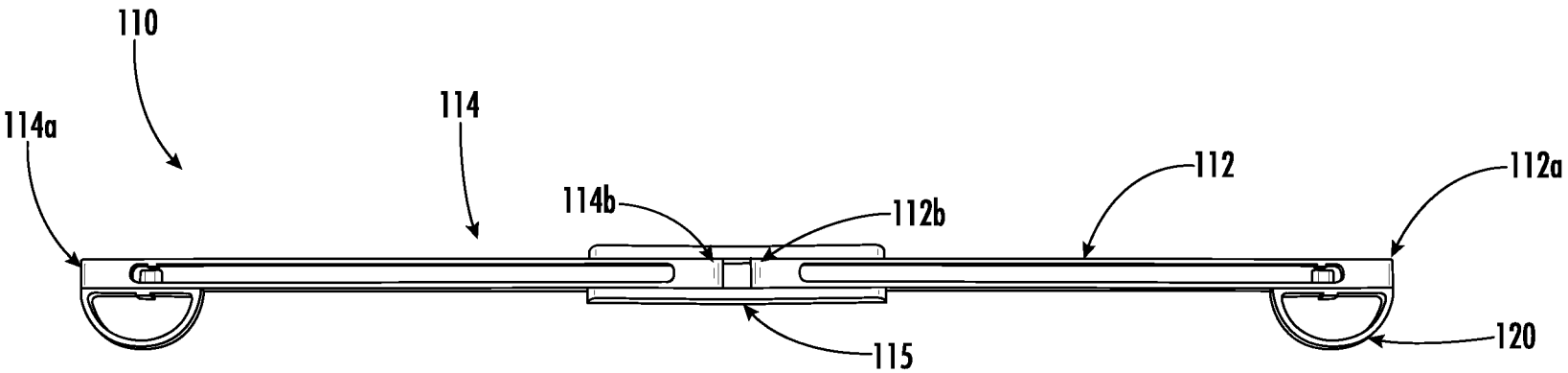
Figure 2B:
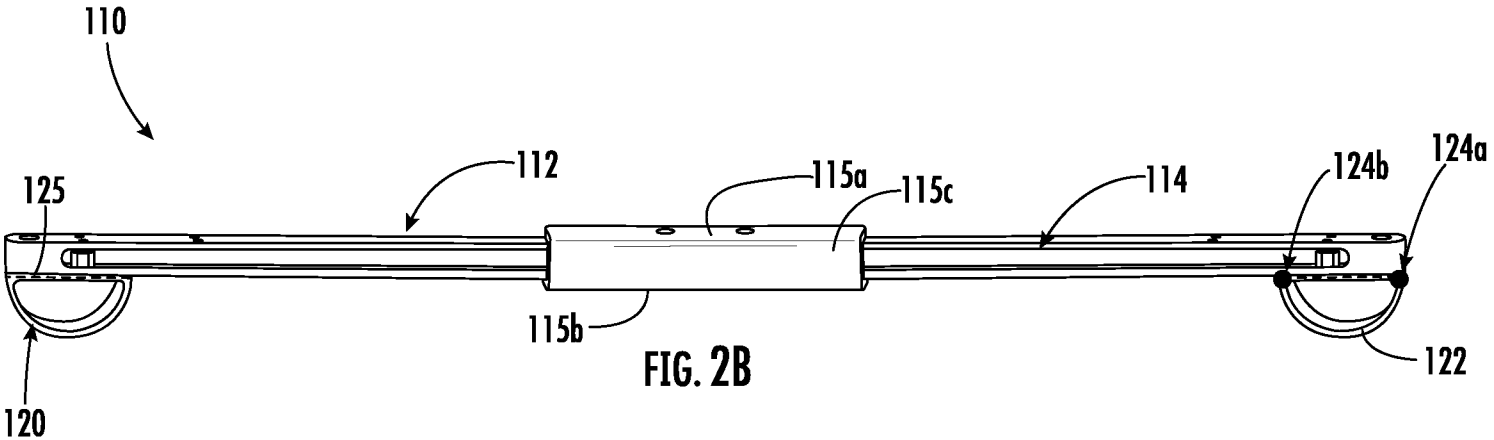
Figure 3:
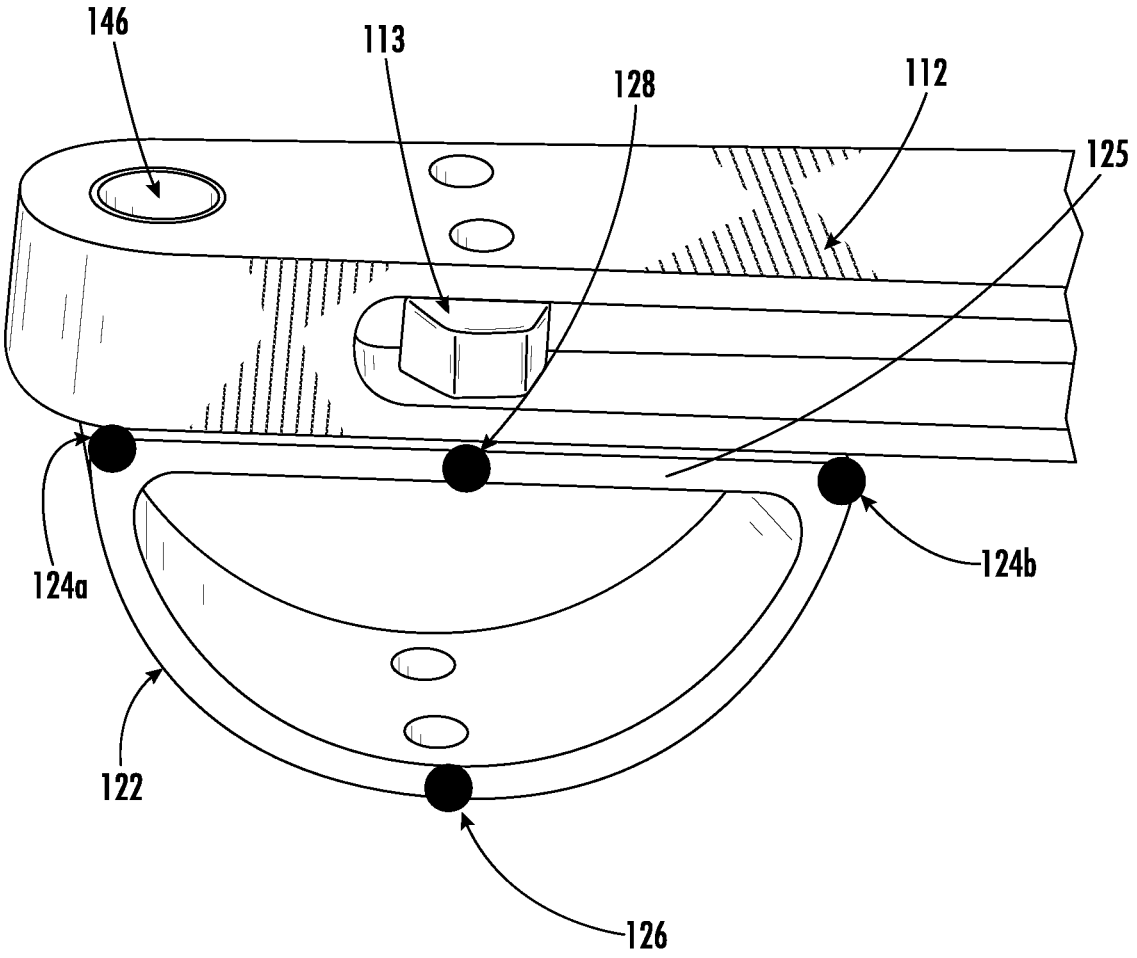
Figure 4A:
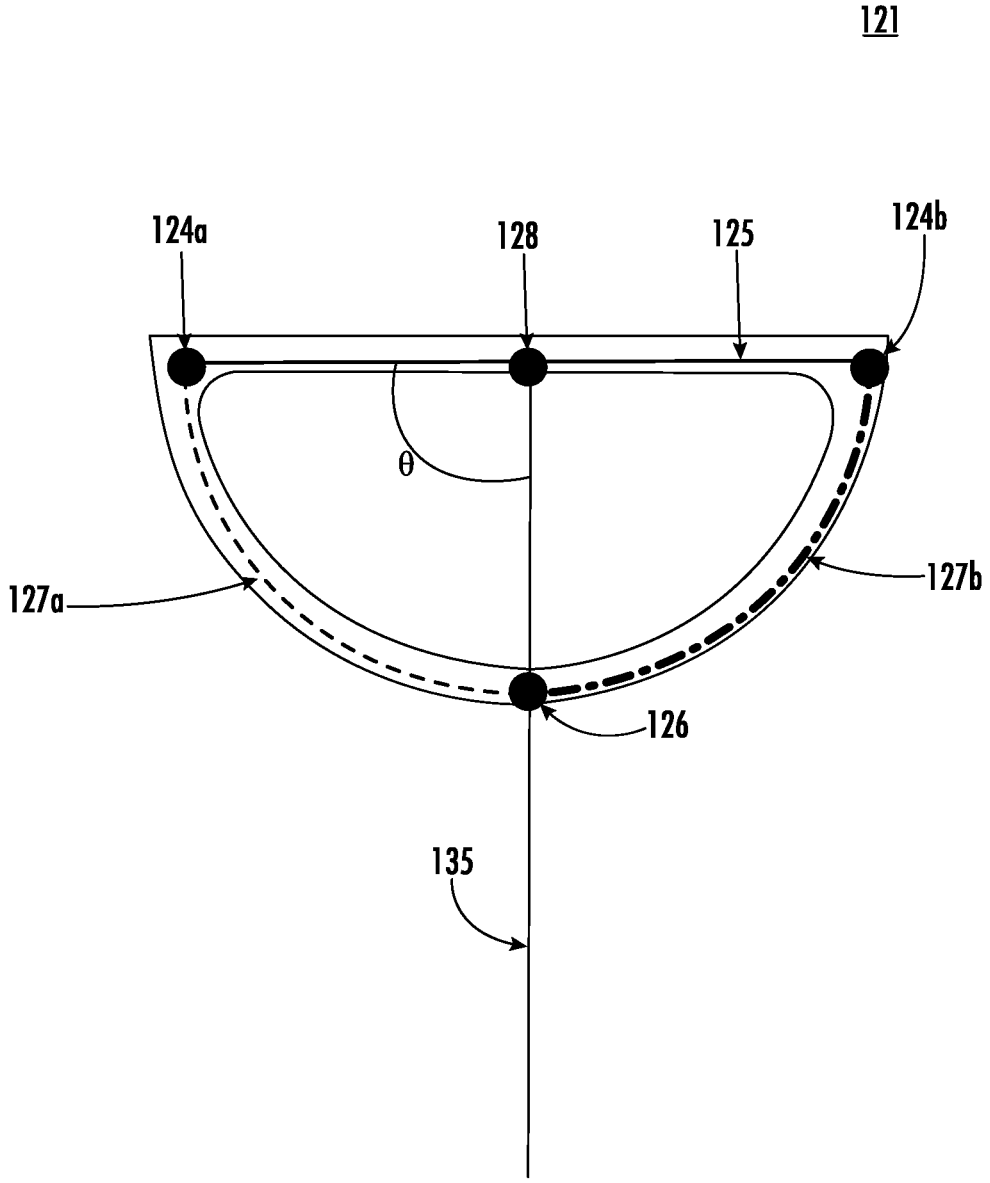
Figure 4B:
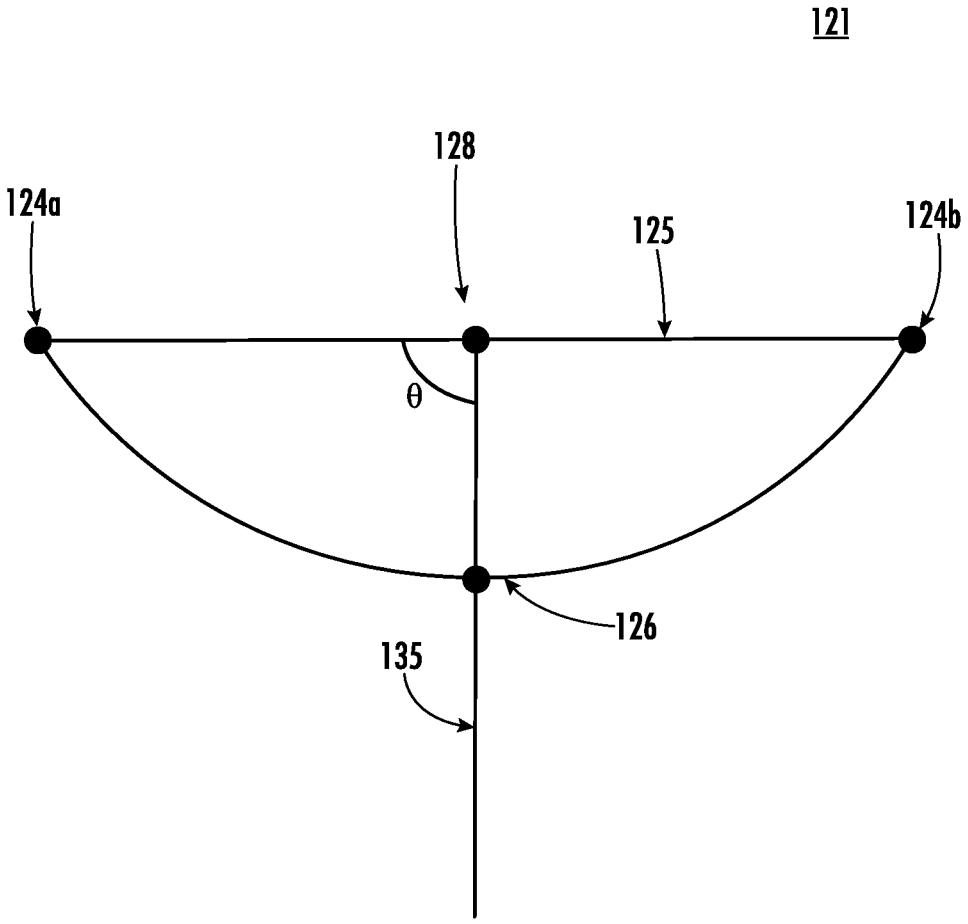
Figure 4C:
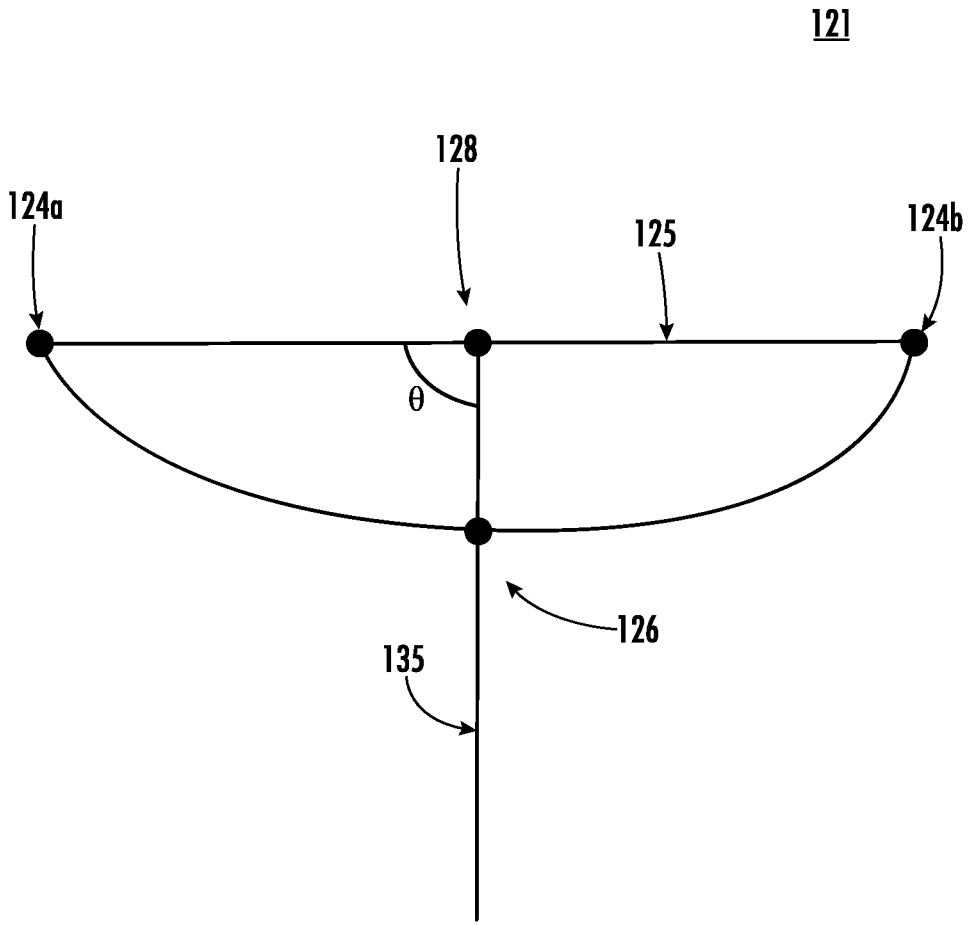
Figure 5A:
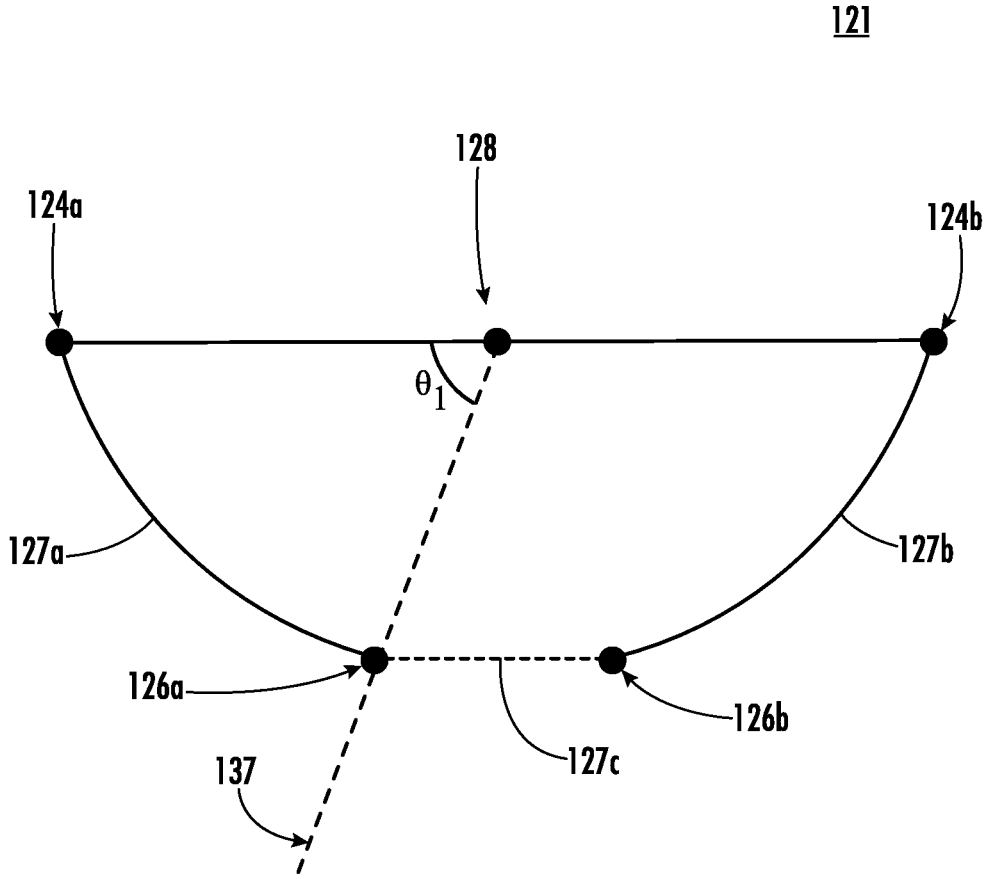
Figure 5B:
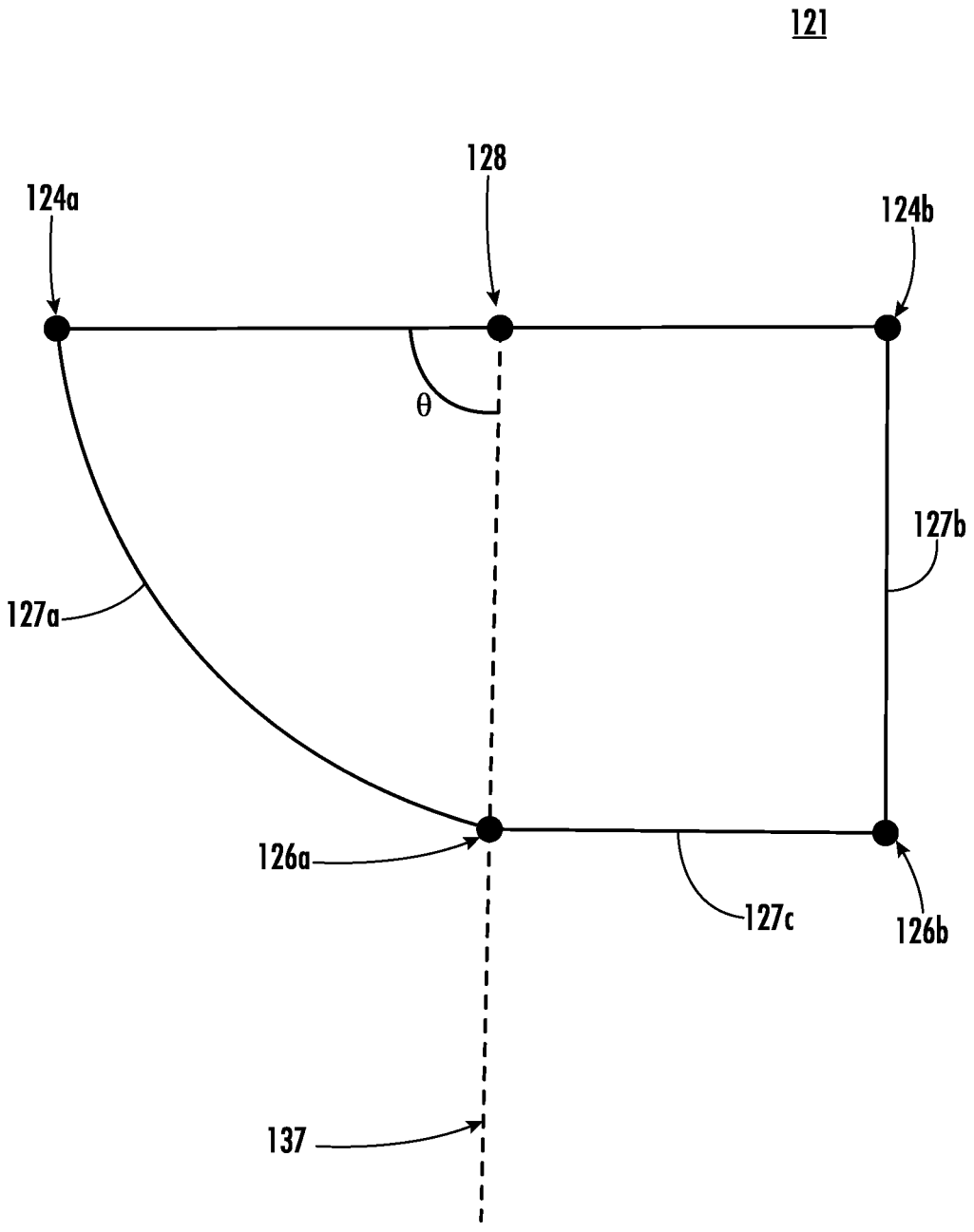
Figure 5C:
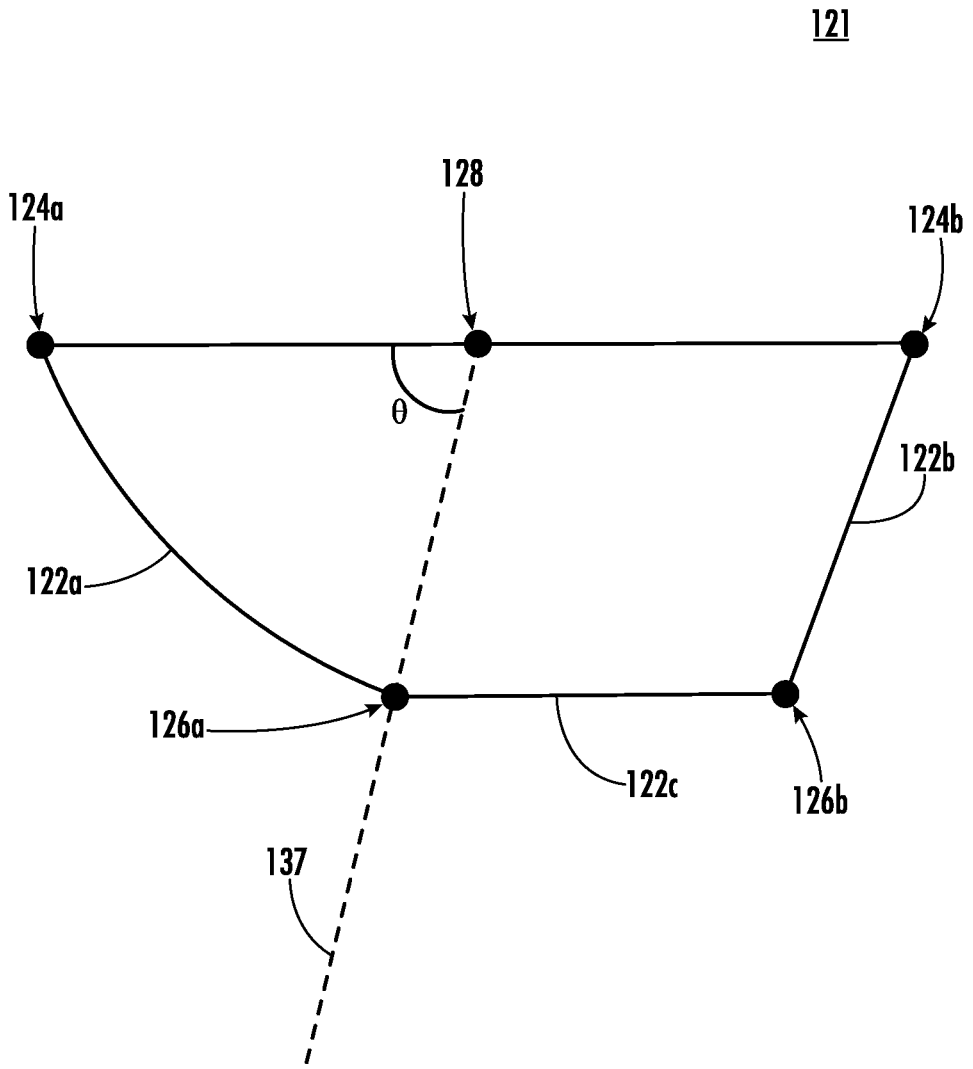
Figure 6A:
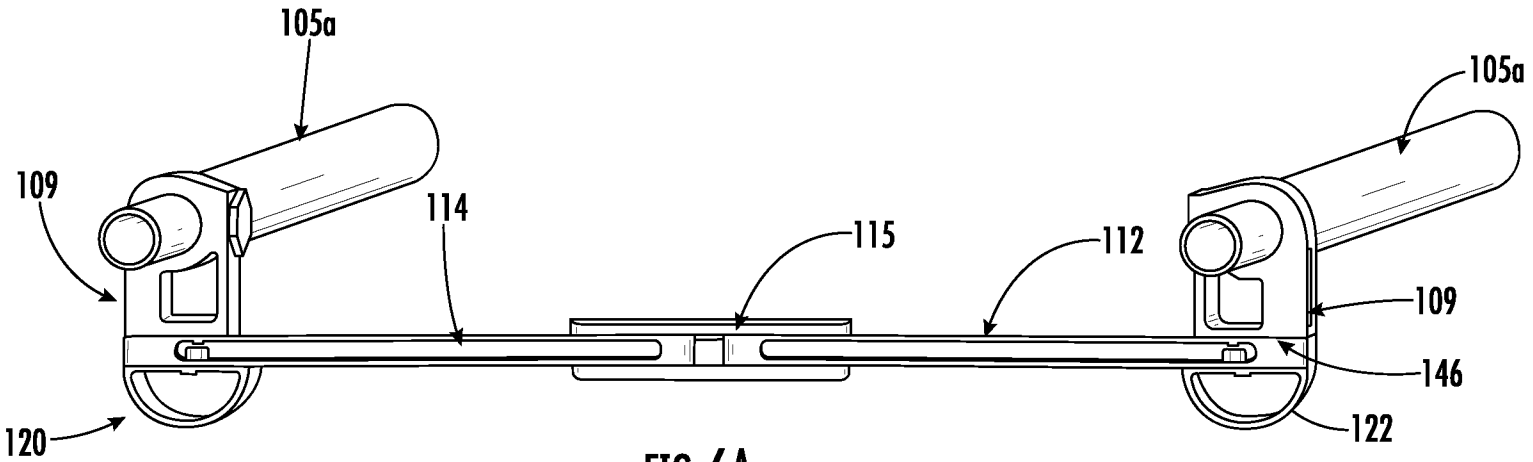
Figure 6B:
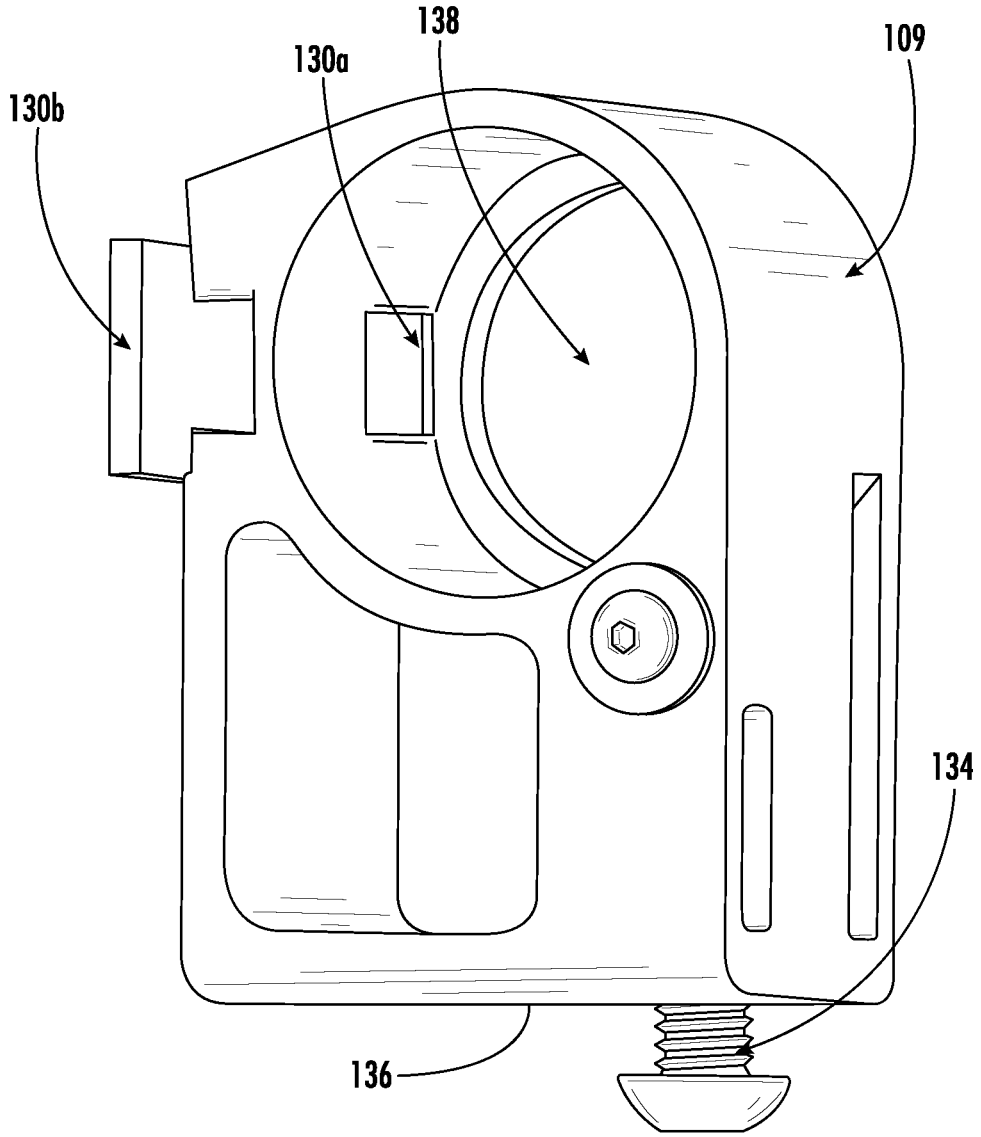
Figure 6D:
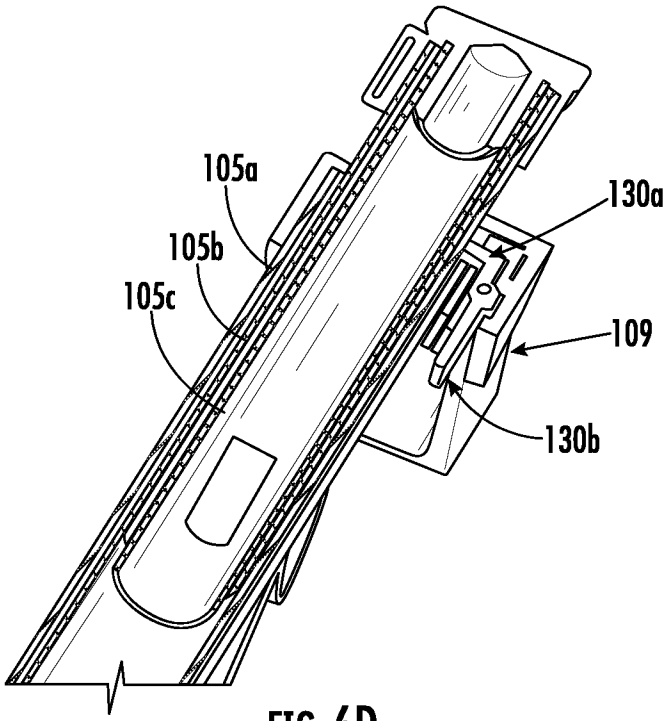
Figure 6C:
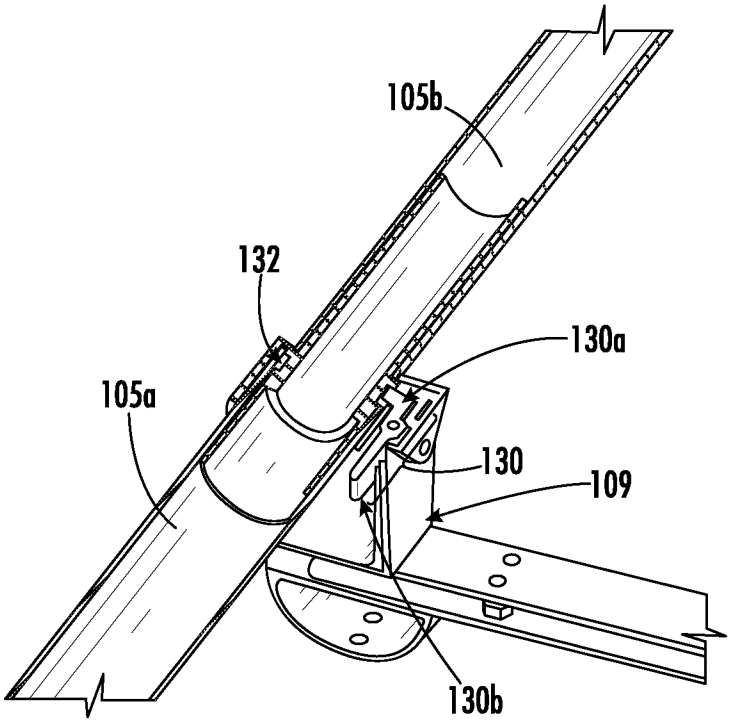
Figure 6E:
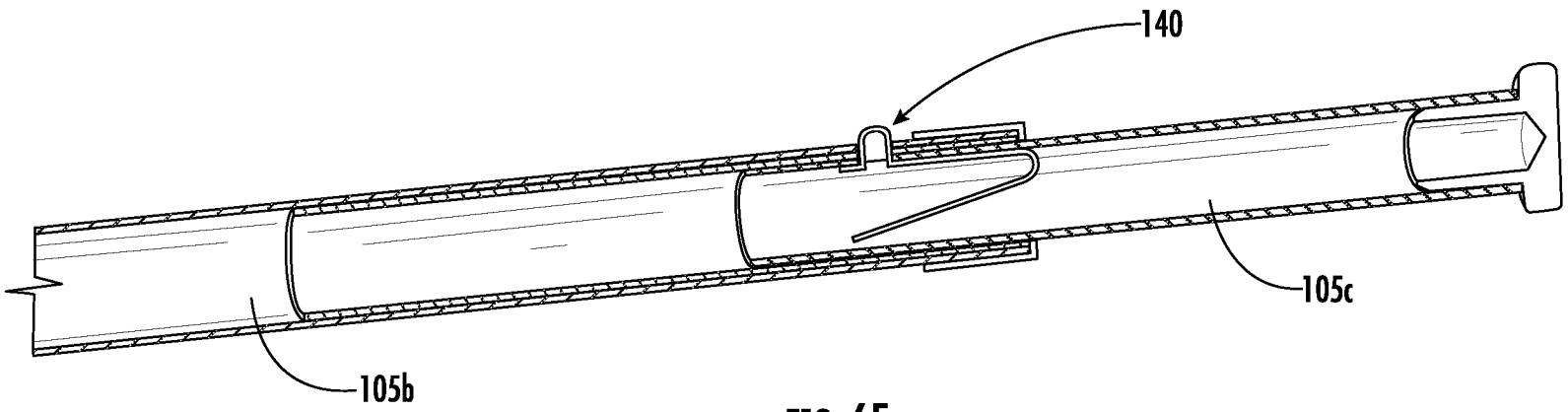
Figure 6F:
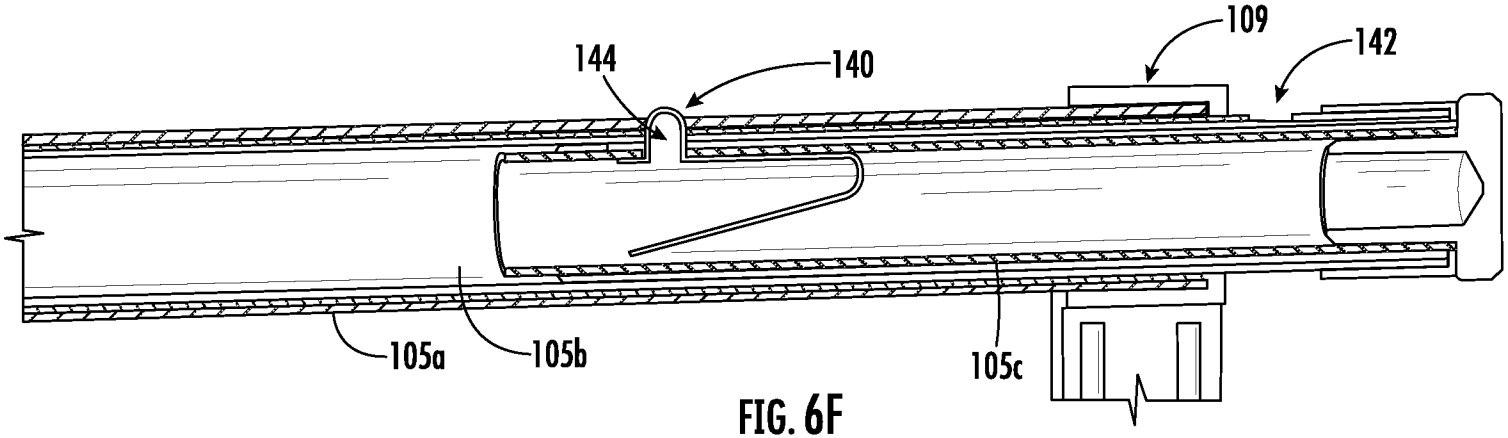
Figure 7A:
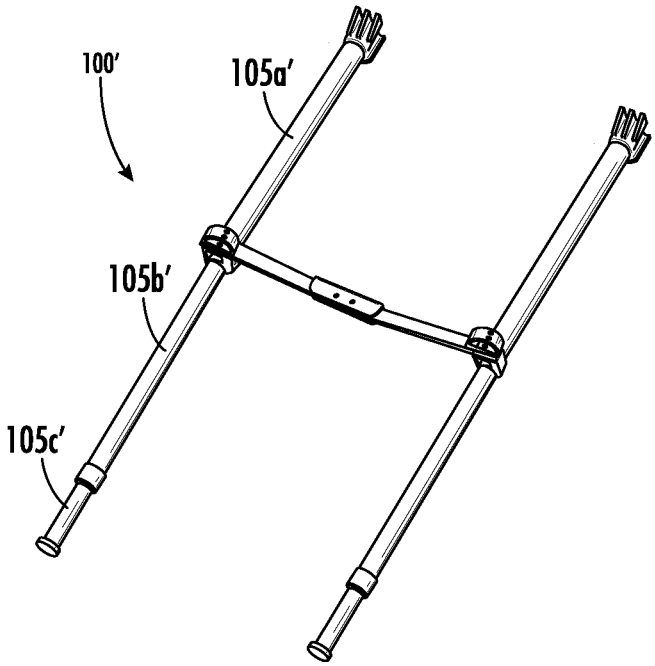
Figure 7B:
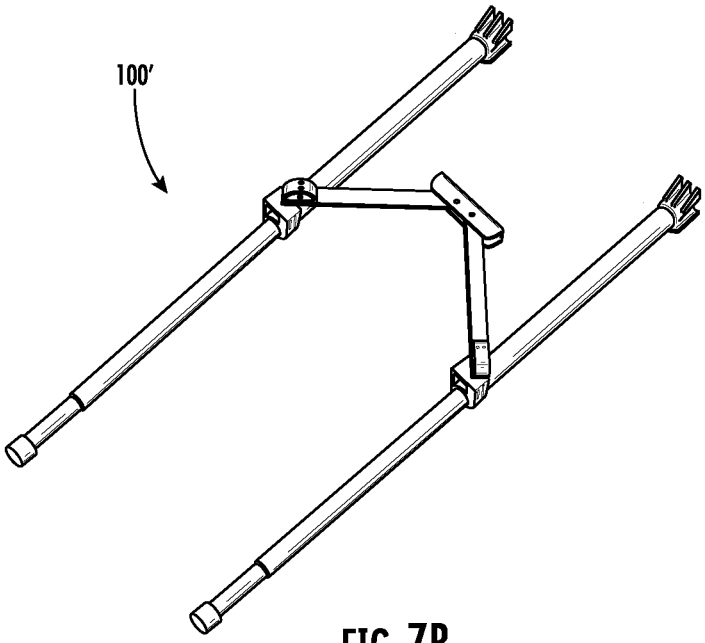
Figure 7C:
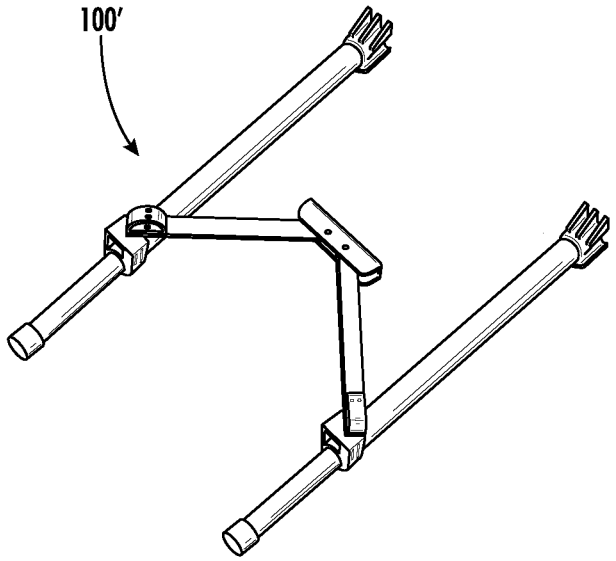
Figure 7D:
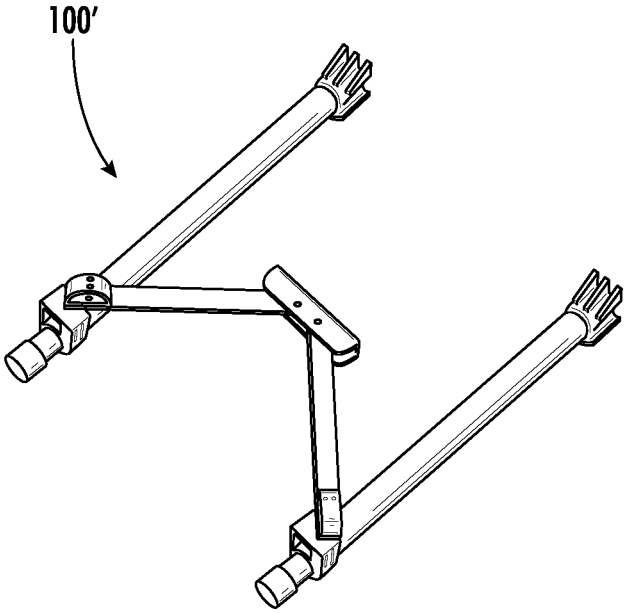
Figure 7E:
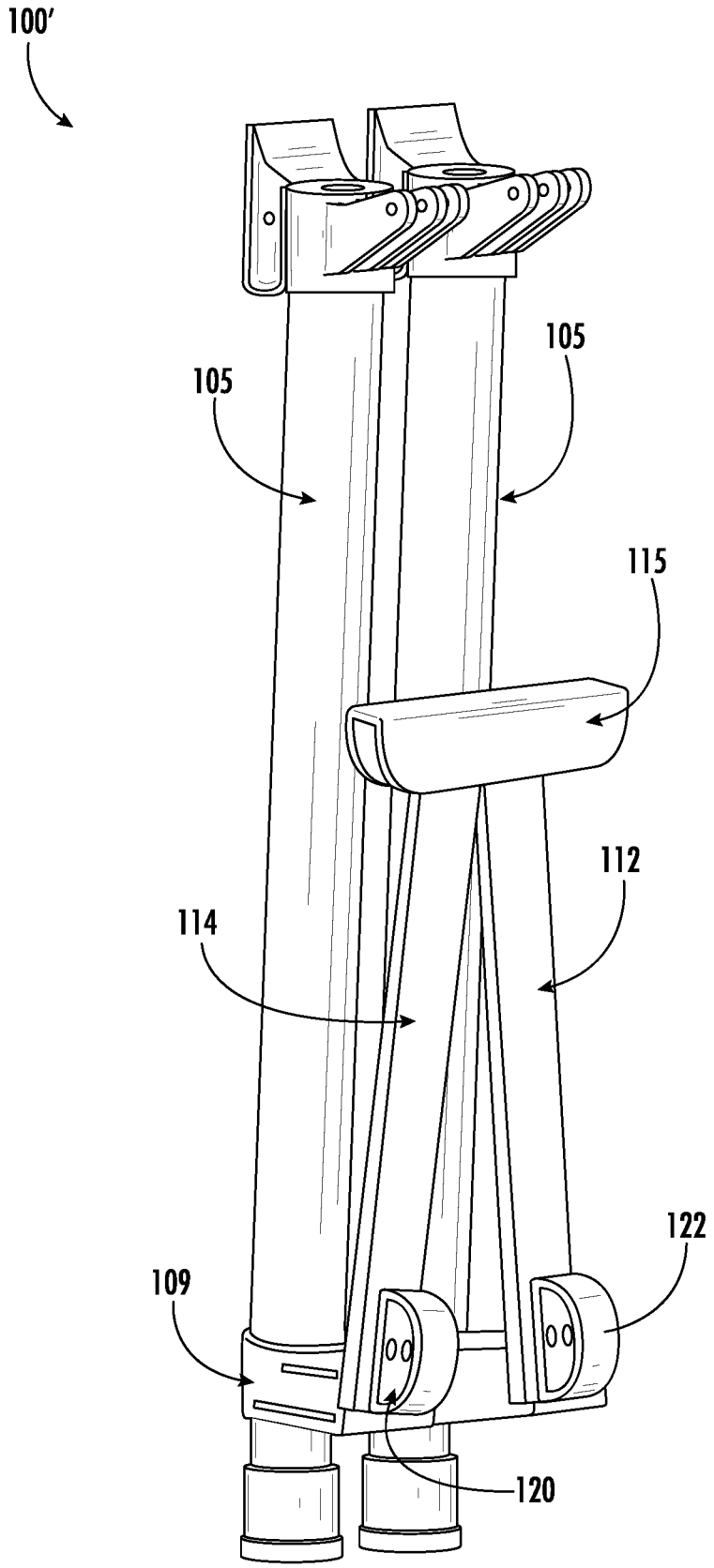
Figure 8A:
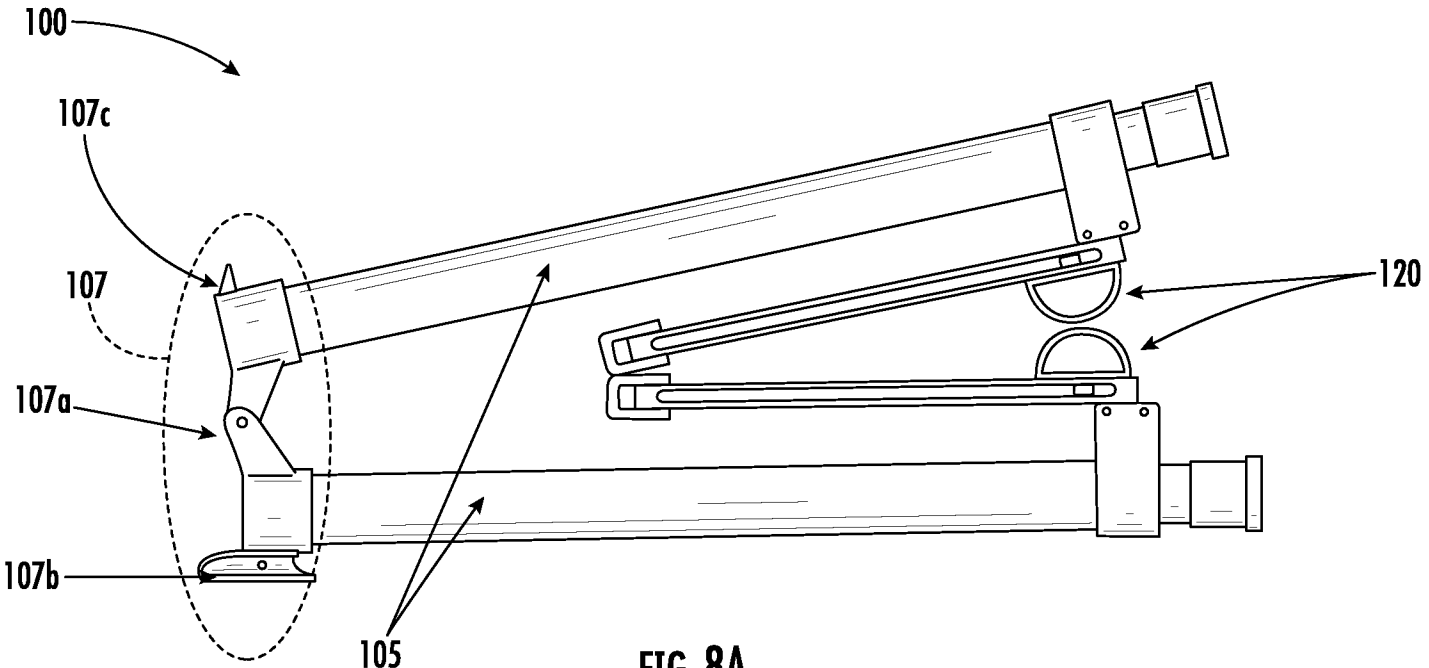
Figure 8B:
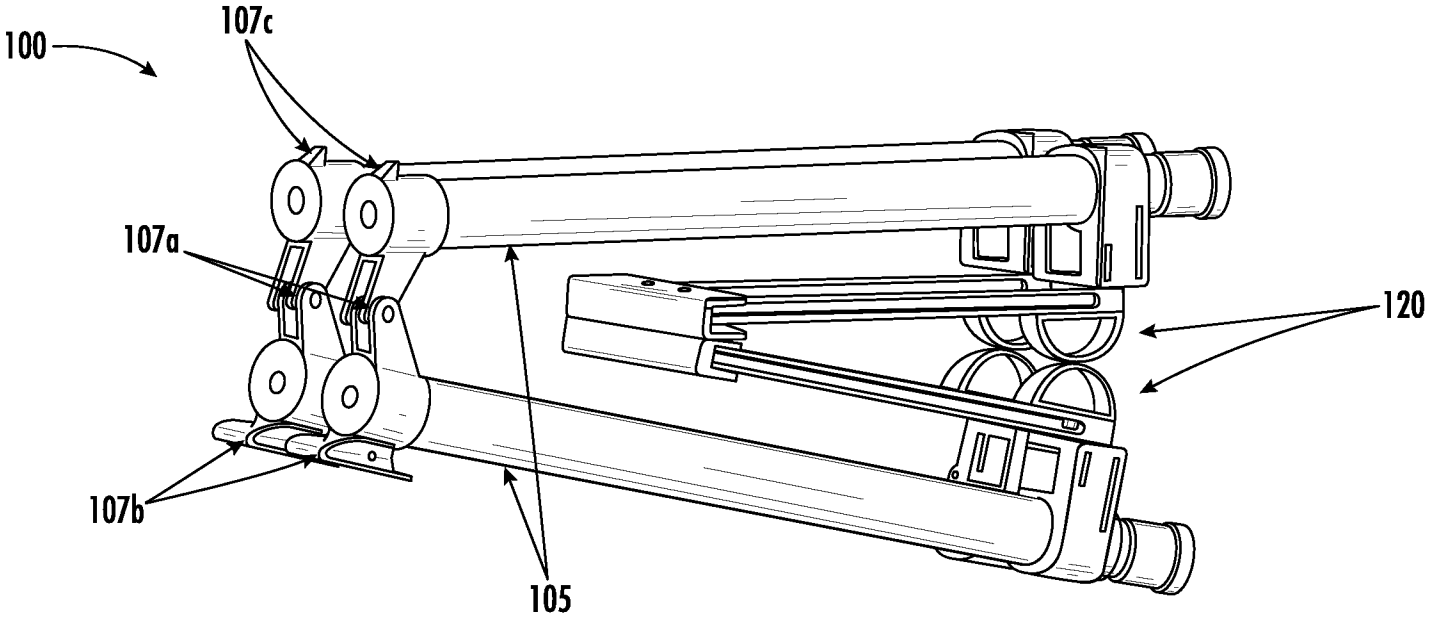
Figures 9A, 9B:
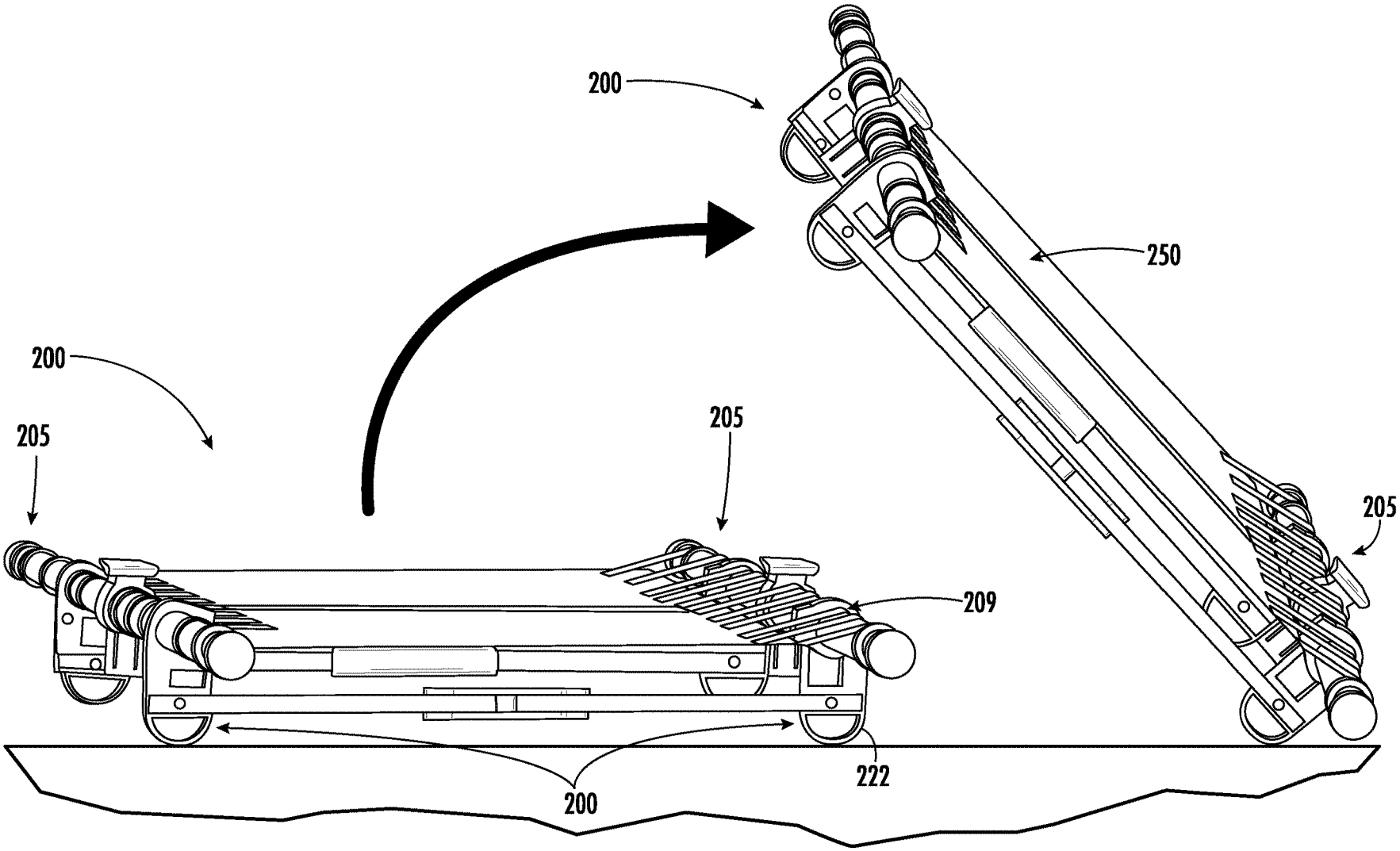
Figure 9C:
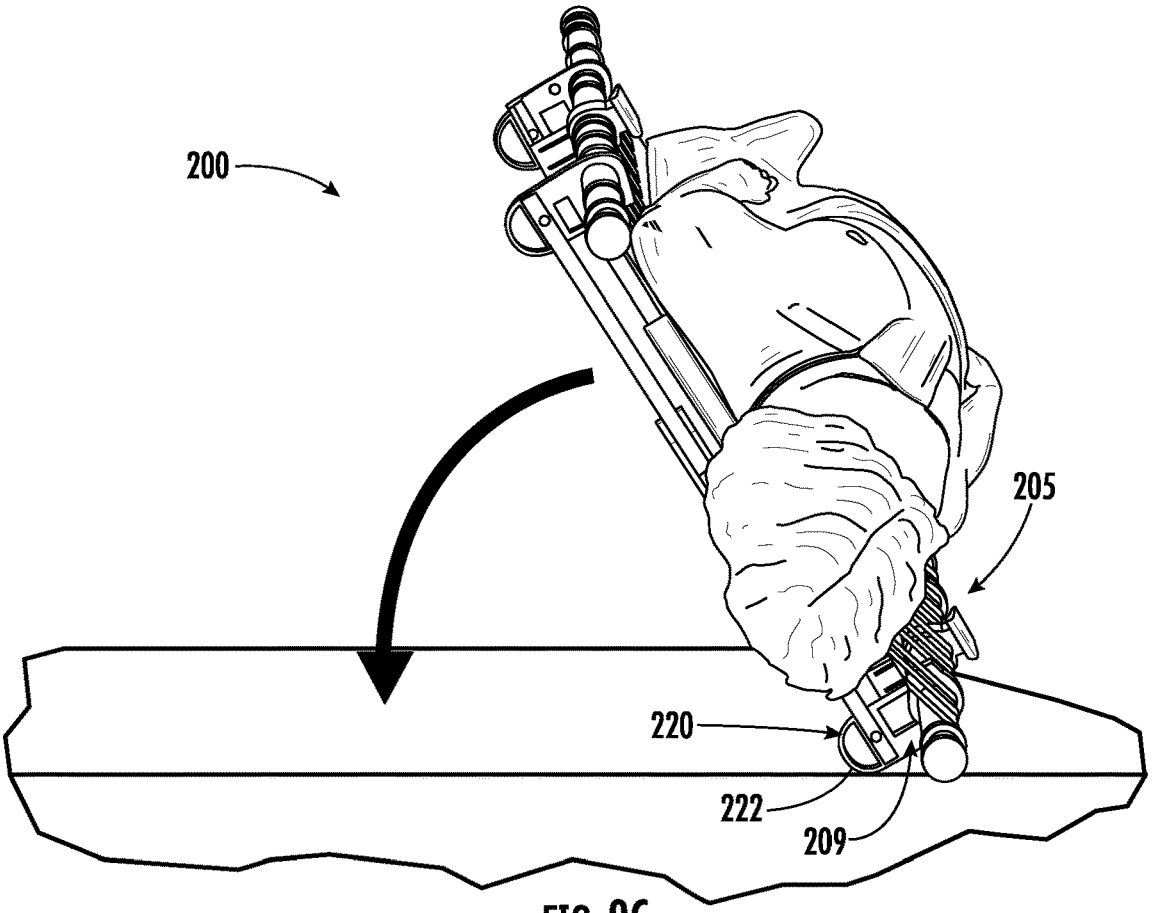
Figure 9D:
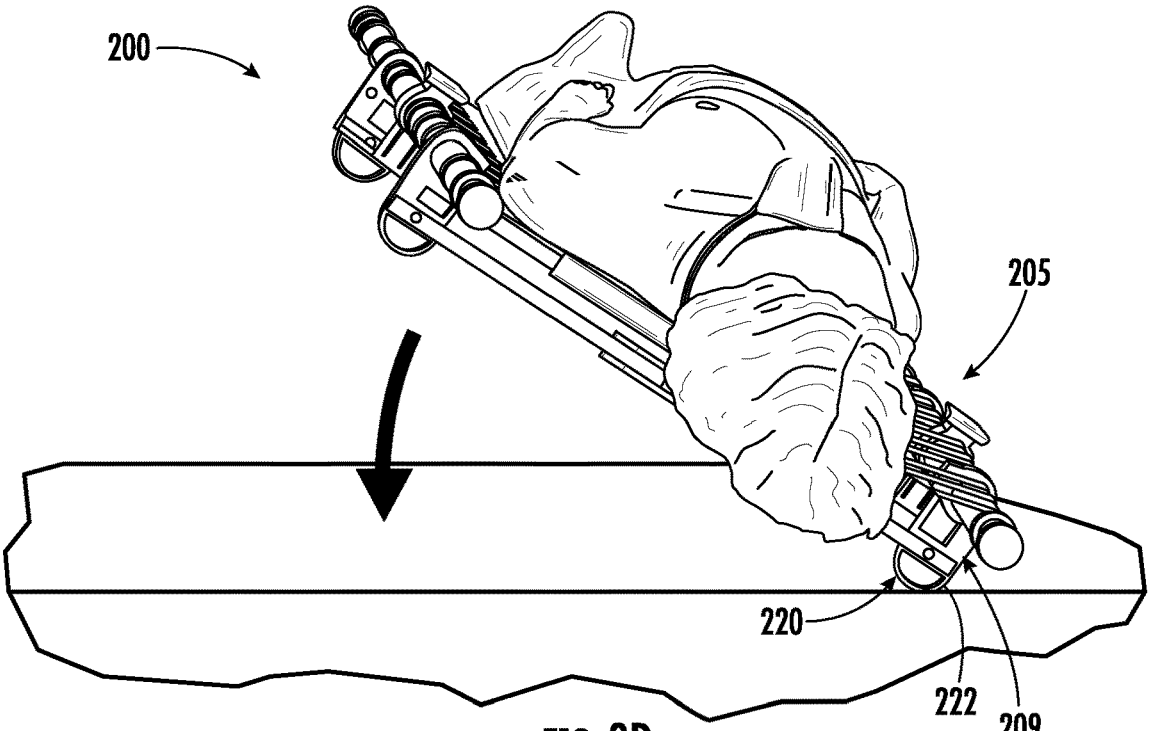
Figure 9E:
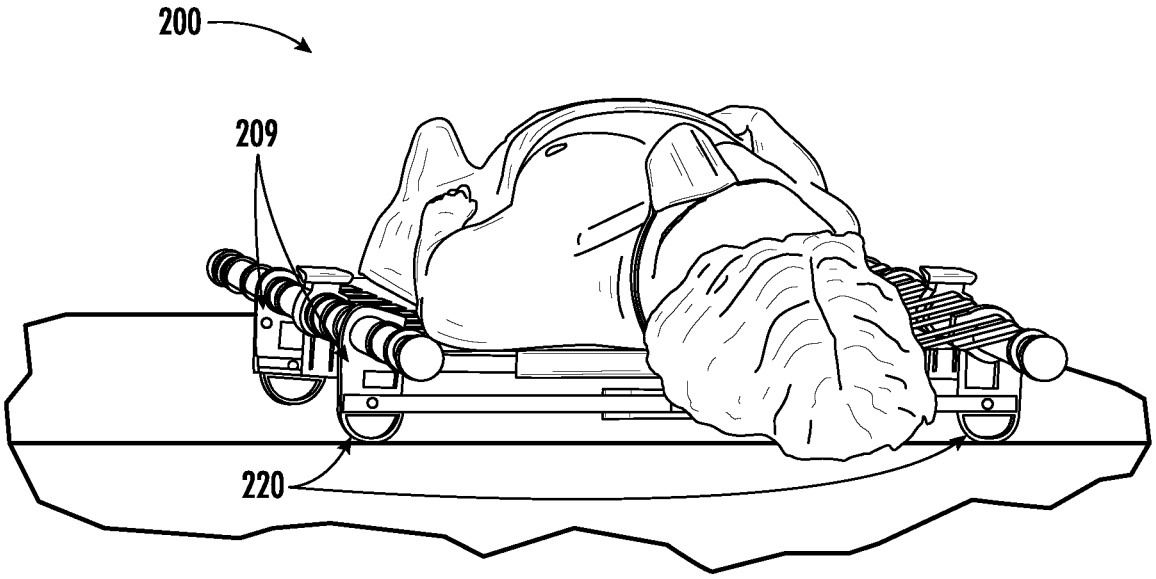
Figure 10:
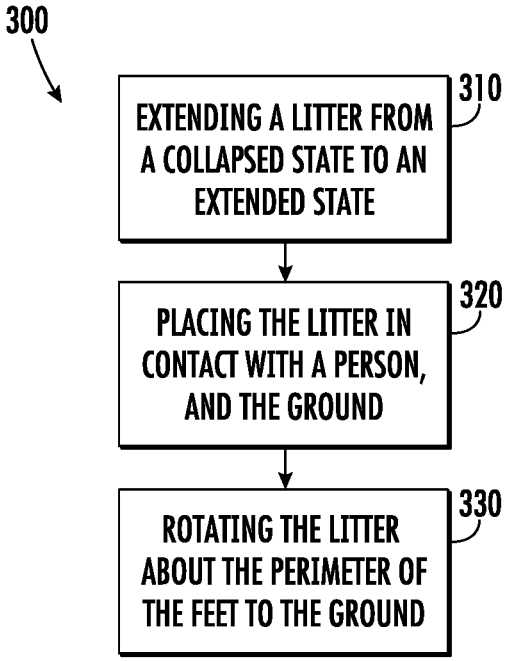
Figure 11:
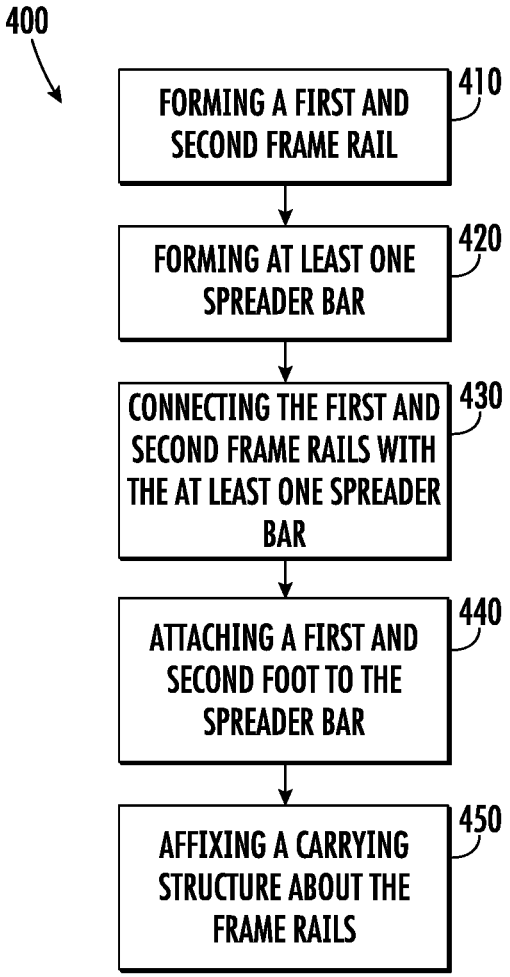

Having thus described the invention in general terms, reference will now be made to the accompanying drawings, which are not necessarily drawn to scale, and wherein:

FIG. 1A illustrates a top view of an example litter frame assembly, in accordance with some embodiments discussed herein;

FIG. 1B illustrates a first perspective view of the example litter frame assembly in an extended position, in accordance with some embodiments discussed herein;

FIG. 1C illustrates a second perspective view of the example frame assembly in the extended position, in accordance with some embodiments discussed herein;

FIG. 1D illustrates a bottom perspective view of the example litter in the extended position, in accordance with some embodiments discussed herein;

FIG. 2A illustrates a first view of an example spreader bar of the frame assembly in an extended position, in accordance with some embodiments discussed herein;

FIG. 2B illustrates a second view of the example spreader bar of the frame assembly in an extended position, in accordance with some embodiments discussed herein;

FIG. 3 illustrates a perspective view of an example foot, in accordance with some embodiments discussed herein;

FIG. 4A illustrates a cross-sectional view of an example foot, in accordance with some embodiments discussed herein;

FIG. 4B illustrates a cross-sectional schematic view of another example foot configuration, in accordance with some embodiments discussed herein;

FIG. 4C illustrates a cross-sectional schematic view of another example foot configuration, in accordance with some embodiments discussed herein;

FIG. 5A illustrates a cross-sectional schematic view of another example foot configuration, in accordance with some embodiments discussed herein;

FIG. 5B illustrates a cross-sectional schematic view of another example foot configuration, in accordance with some embodiments discussed herein;

FIG. 5C illustrates a cross-sectional schematic view of another example foot configuration, in accordance with some embodiments discussed herein;

FIG. 6A illustrates a perspective view of the connection between the frame rails and the spreader bars, in accordance with some embodiments discussed herein;

FIG. 6B illustrates a perspective view of an example attachment feature, in accordance with some embodiments discussed herein;

FIG. 6C illustrates a cross-sectional view of the frame assembly in an extended configuration, in accordance with some embodiments discussed herein;

FIG. 6D illustrates a cross-sectional view of the frame assembly in a collapsed configuration, in accordance with some embodiments discussed herein;

FIG. 6E illustrates a cross-sectional view of the frame assembly in an extended configuration, in accordance with some embodiments discussed herein;

FIG. 6F illustrates a cross-sectional view of the frame assembly in a collapsed configuration, in accordance with some embodiments discussed herein;

FIG. 7A illustrates a perspective view of a portion of an example litter in the extended configuration, in accordance with some embodiments discussed herein;

FIGS. 7B-7D illustrate perspective views of the litter portion of FIG. 7A transitioning from the extended configuration to the collapsed configuration, in accordance with some embodiments discussed herein;

FIG. 7E illustrates a perspective view of the litter portion of FIG. 7A in a collapsed configuration, in accordance with some embodiments discussed herein;

FIGS. 8A-B illustrate perspective views of an example litter in the collapsed configuration, in accordance with some embodiments discussed herein;

FIGS. 9A-B illustrate an example litter being rotated from a flat position to a loading position, in accordance with some embodiments discussed herein;

FIG. 9C-9E illustrate the example litter receiving a person and rotating from the loading position to the flat position, in accordance with some embodiments discussed herein;

FIG. 10 illustrates an example flow chart of the method of use of an example litter, in accordance with some embodiments discussed herein; and FIG. 11 illustrates an example flow chart of the method of manufacture of an example litter, in accordance with some embodiments discussed herein.

DETAILED DESCRIPTION

Example embodiments of the present invention now will be described more fully hereinafter with reference to the accompanying drawings, in which some, but not all embodiments of the invention are shown. Indeed, the invention may be embodied in many different forms and should not be construed as limited to the example embodiments set forth herein; rather, these embodiments are provided so that this disclosure will satisfy applicable legal requirements. Like reference numerals refer to like elements throughout.

The term "apex" as used herein may refer to a point that corresponds to a local minimum. For example, one or more points along a cross-section for a foot perimeter that is the furthest away vertically from an attachment surface (e.g., top of the foot) may define apex points. Example apex points are illustrated and described with respect to FIGS. 3-5C.

The term "vertical" as used herein may refer to generally up and down. To the extent a specific direction (e.g., up, down, side, etc.) is used, such terms are meant for explanatory purposes and are not designed to be limited to the specifically termed direction. In this regard, other directions are contemplated, such as based on different frames of reference.

The term "radius of curvature" as used herein may refer to the reciprocal of the curvature. For example, for a curve it equals the radius of the circular arch which best approximates the curve at that point.

Some example embodiments of the present invention include lightweight (e.g., less than 10 lbs.) litters that are collapsible, compact, easy to assemble, and provide a smooth transition for an injured or incapacitated person between the ground (or injury site) and the litter for transportation or to be used as a stable surface.

Some embodiments of the present invention provide a light weight, collapsible litter frame assembly having rounded feet to provide a smooth transition between a loading position and a neutral position (e.g., a flat position that is parallel with the ground). FIG. 1A illustrates an example frame assembly 100. The frame assembly 100 may include two frame rails 105, each having an exterior side 105*d* and an internal side 105*e* opposite one another. The internal sides 105*e* of the pair of frame rails may face and frame a middle space 108 therebetween. In some embodiments, the frame rails 105 may be parallel, defining a symmetrical middle space, while in other embodiments the frame rails 105 may be slightly off parallel, wherein two ends of the frame rails are closer together than the others.

In some embodiments, each of the frame rails may be formed from telescoping rods extending in a longitudinal direction. Each of the frame rails 105 may be further formed from a series of telescoping rods hingedly connected. Each telescoping rod may include three telescoping segments including a primary telescoping rod 105*a*, a secondary telescoping rod 105*b* and a tertiary telescoping rod 105*c*. The tertiary telescoping rod 105*c* may be telescopingly received by the secondary telescoping rod 105*b* , which may then be telescopingly received by the primary telescoping rod 105*a*. In this regard, each of the telescoping segments are formed as hollow structures. In some embodiments, the frame rails 105 may have a circular cross-section, while in other embodiments the frame rails 105 may have an ovate or other cross-section. In this regard, although rounded cross-sections are illustrated and discussed, any acceptable cross-section may be used.

In some embodiments, each of the frame rails may comprise two primary telescoping rods 105*a* hingedly connected together (e.g., at a connection mechanism 107). In some embodiments, the connection mechanism 107 may be a hinge 107*a* secured by a latch 107*b* interacting with an attachment protrusion 107*c* (see e.g., FIG. 8A). For example, one primary telescoping rod of the first frame rail may have a protrusion 107*c* extending above a top side of the frame rail, configured to retain a latch 107*b* on the top side of the opposing primary telescoping rod. In some embodiments, the hinge 107*a* may be on the lower side of the frame rail, with the latch on the opposite side. When the litter is in the collapsed configuration, the hinge 107*a* may open up to 180 degrees. In some embodiments, the hinge may only extend up to 170, or 160 degrees, and may have some interference from other components of the litter (e.g., carrying structure, or feet).

As illustrated in FIG. 1B, in some embodiments, each of the telescoping segments may have an attachment feature 109 attached to the primary telescoping rod 105*a*, e.g., at an opposite end from the connection mechanism 107. In some embodiments, the attachment feature 109 is disposed about the exterior surface of the frame rail 105 and may also extend below the frame rail 105. The attachment feature 109, as described in further detail below, may secure the telescoping segments of the frame rails 105 in the extended configuration, such that the frame rails remain extended unless a locking piece 130 within each of the attachment features 109 is disengaged and the telescoping segments of the frame rails are returned to a collapsed configuration.

The frame assembly 100 may further include at least one spreader bar 110 disposed between the frame rails 105 to secure the middle space 108 therebetween (e.g., the spreader bar helps maintain the frame rails 105 in relative parallel fashion with respect to each other so as to define a space sized to receive an injured person once the carrying structure is attached). In some embodiments, the spreader bar may be attached to each of the frame rails 105 at the attachment feature 109, while in other embodiments, the spreader bar 110 may be directly attached to the frame rail 105. Each of the spreader bars 110 may include at least one foot 120 vertically aligned with the frame rails such that the exterior of the foot is aligned with the exterior surface of the frame rail 105. The feet 120 may be configured to support the frame assembly 100 on a surface (e.g., the ground).

Returning to FIG. 1A, the frame assembly 100 may have two parallel frame rails 105, each having a first and second primary telescoping rod 105*a* attached by a connection mechanism 107. The frame assembly 100 may include a first spreader bar and a second spreader bar attached to the primary telescoping rods 105*a*. In some embodiments, the first spreader bar is attached to the first primary telescoping rods 105*a* opposite the connection mechanism 107, and a second spreader bar is attached to the second primary telescoping rods 105*a* opposite the connection mechanism 107.

In some embodiments, the frame assembly 100 may be made from a light-weight material. For example, in some embodiments, the frame assembly may be formed from a carbon fiber alloy. In some embodiment, the carbon fiber alloy may include carbon fiber and aluminum. In some embodiments, the alloy may contain up to 30% carbon fiber, up to 40% carbon fiber, or even up to 50% carbon fiber.

In some embodiments, the frame assembly 100, may further include a carrying structure 150 secured between the pair of frame rails. As illustrated in FIG. 1D, the carrying structure 150 may be solid throughout the middle space. While in other embodiments, the carrying structure 150 may have a plurality of holes spaced such that enough structure remains to support an injured person, while allowing for less weight. The carrying structure 150 may be secured about each frame rail 105 by loops. Each loop may be detachable (e.g., secured with hook and loop fasteners), or permanently adhered (e.g., stitched) to the carrying structure 150. In some embodiments, the carrying structure 150 may be a fabric, and in some embodiments may be made from canvas, cotton, polyester, plastic fibers, nylon, or other light weight material.

In some embodiments, handles 152 may be secured about each of the tertiary telescoping rods 105*c*. The handles 152 may be made from any material, such as the same material as the carrying structure 150, while in other embodiments the handles 152 may be a more rigid material.

FIG. 2A and 2B illustrate perspective views of an example spreader bar. Each spreader bar 110 may be configured to transition between an extended configuration and a collapsed configuration. Each spreader bar 110 may have a first arm 112 with an exterior end 112*a* and an internal end 112*b*, and a second arm 114 having an exterior end 112*a* and an internal end 112*b* wherein the exterior ends are opposite the internal ends. Each of the first arm 112 and the second end 114 may be rotatably secured to a coupler 115 at each of the internal ends 112*b*, 114*b*.

The coupler 115 may be an elongated body configured as a "C" or a "U" shape to envelop each of the internal ends 112*b*, 114*b*. The coupler 115 may be hingedly connected to each internal end 112*b*, 114*b*, such that the respective arm may transition between an extended configuration and a collapsed configuration. The arms 112, 114 may be evenly spaced within the coupler so a portion of the arm is retained within the body of the coupler 115 when the arms are in the extended configuration. In some embodiments, when the spreader bar 110 is in an extended configuration, the arms define an angle of 180 degrees, up to 180 degrees, or up to 190 degrees. In some embodiments, when the spreader bar 110 is in a collapsed configuration, the arms define an angle of up to 30, up to 20 or up to 10 degrees.

As illustrated in FIG. 2B, the coupler 115 may be solid around three sides of the arms. Two of the surfaces may be about the top surface 115*a* and bottom surface 115*b* of the arms, while the third one is on an interior side such that the arms cannot extend beyond the interior surface. In some embodiments, the interior surface 115*c* prevents the arms from rotating to create an angle of more than 190 degrees between the arms. In some embodiments, the coupler 115 may have a length to retain the arms so they are supported and cannot rotate past the internal surface 115*c*. In the collapsed configuration, the first and second arms may rotate such that each arm is perpendicular to the coupler 115.

As previously discussed, the spreader bar 110 may be attached to the frame rail. In some embodiments, each of the exterior ends 112*a*, 114*a* may be rotatably attached to an attachment feature 109, or directly to the frame rail 105. Each of the arms 112, 114 may rotate up to 100 degrees, up to 95 degrees, or up to 90 degrees between being parallel to the frame rails 105 in the collapsed configuration and being perpendicular to, or substantially perpendicular to, the frame rails 105 in the extended configuration.

Each spreader bar arm 112, 114 may have a foot 120 attached to the exterior side 112*a*, 114*a*. The foot may have a top which defines an attachment surface 125. In some embodiments, the attachment surface 125 may be flush with the bottom surface of the spreader bar. The attachment surface 125 may define an exterior contact point 124*a*, and an internal contact point 124*b*. In some embodiments, the attachment surface 125 is planar between the exterior and internal contact points, while in other embodiments it may be concave with respect to the arm. In some embodiments, foot 120 may define a surface 122 extending between the exterior and internal contact points below the spreader bar 110 to define a bottom of the foot 120.

The foot 120 may be attached to the spreader bar with an attachment mechanism through a mounting feature. In some embodiments, the attachment mechanism may be a screw, a bolt and rivet, a peg and dowel, or similar. The mounting feature may be centered along the attachment surface 125. In some embodiments, the mounting feature may be one or more apertures through the attachment surface 125 configured to receive one or more attachment mechanisms. In some embodiments, there are multiple attachment mechanisms to attach each foot 120 to the arm, such that the foot 120 is stationary in relation to the arm. In some embodiments, the attachment surface 125 has a width that is equal to, or substantially similar to the width of the spreader bar 110. The similar widths afford support and even weight distribution when an injured or unconscious person occupies the litter.

In some embodiments, the attachment mechanism may be removable, such that each foot may be moved from a first position (e.g., exterior contact point vertically aligned with the exterior side of the frame rail) to a second position inward on the arm of the spreader bar. In this regard, the feet may define any position along the spreader bar. Further, in some embodiments, the feet may be attached to the frame rails directly.

FIG. 3 illustrates a perspective view of an example foot 120 attached to a spreader bar arm 112. In some embodiments, the attachment surface 125 may define a center point 128, positioned along the attachment surface 125 in the center between the exterior and internal contact points 124*a*, 124*b*. In some embodiments, the center point 128 is the point where the attachment surface 125 is secured by the attachment mechanism 113 to the spreader bar arm, for example, with a screw. In some embodiments, for example, when the foot has an asymmetrical shape, the point of attachment may be at the center of gravity, or there may be multiple attachment points.

In some embodiments, the surface 122 may curve downward from the exterior contact point between the spreader bar arm 112 and the foot 120 towards the middle space (e.g., inwardly from a horizontal perspective). In some embodiments, the exterior contact point 124*a* may be aligned, vertically, with the exterior side of the frame rail 105. In some embodiments, the surface 122 may maintain the same radius of curvature throughout the foot, such that the foot is semi-circle along the surface 122 between the exterior contact point 124*a* and the internal contact point 124*b*—although other radiuses of curvatures are contemplated.

FIGS. 4A-C illustrate an example cross-sectional plane 121 of a foot 120 on the frame assembly 100, where the cross-sectional plane 121 extends perpendicular to the frame rails 105. Accordingly, a perimeter 127 of the surface 122 may be defined within the cross-sectional plane 121. The perimeter 127 may be formed between the exterior contact point 124*a* and the internal contact point 124*b*. The perimeter 127 may descend vertically below and laterally along the attachment surface 125. The foot may define an apex point 126, along the perimeter 127 at a point where the perimeter 127 and the attachment surface have the greatest vertical separation. In some embodiments, the perimeter 127 may be curved from the exterior contact point 124*a* to the apex point 126.

In some embodiments, the foot 120 may have different perimeter shapes, to accommodate varying uses or terrains. To explain, in the illustrated embodiment, the perimeter 127 includes an exterior portion 127*a*, an internal portion 127*b*, and an apex point 126. The apex point 126 may be the transition point between the exterior portion 127*a* and the internal portion 127*b* of the perimeter 127. In some embodiments, the exterior portion 127*a* descends away from the attachment surface 125 from the exterior contact point 124*a* to the apex point 126, and the internal portion extends from the apex point 126 back towards the attachment surface 125 at the internal contact point 124*b*. In some embodiments, the exterior portion 127*a* extends in a first direction that is laterally towards, and vertically away from the center point 128, and the internal portion 127*b* extends away from the internal contact point 124*b* in a second direction laterally towards, and vertically away from the center point 128.

In some embodiments, a plane 135 may extend between the apex point 126 and the center point 128 and parallel to the longitudinal axis of the frame. The plane 135 (when viewed from the cross-sectional plane 121) may define an angle θ with the attachment surface 125 (which may correspond to its own plane—e.g., an attachment surface plane). In some embodiments, the angle θ may be about 90 degrees, as illustrated in FIG. 4A, while in other embodiments may be less than 90 degrees, as illustrated in FIG. 5A.

In some embodiments, both the exterior and internal portions 127*a*, 127*b* of the perimeter 127 may have a smooth curve extending between the point of contact and the apex point. In some embodiments, as illustrated in FIG. 4A, there may be a constant radius of curvature along the perimeter 127, as the foot may be semi-circular shaped. As such, the height of the foot, as measured between the center point 128 and the apex point 126, is equal to the lateral distance between the exterior contact point 124*a* and the center point 128, and likewise the lateral distance between the interior contact point 124*b* and the center point 128.

In other embodiments, as illustrated in FIGS. 4B-4C, the foot 120 may have a changing radius of curvature about the perimeter 127 of the foot. For example, in an embodiment, as illustrated in FIG. 4B, the distance between the apex point 126 and the center point 126 is about half of the distance between the center point 126 and either the exterior contact point 124*a* or internal contact point 124*b*. In an embodiment, as illustrated in FIG. 4C, the distance between the apex point 126 and the center point 126 is less than half of the distance between the center point 126 and either the exterior contact point 124*a* or the internal contact point 124*b*.

In some embodiments, the radius of curvature may change as the perimeter nears the apex point 126. In some embodiments, the perimeter 127 may flatten out about the apex point 126. The flattening of the surface 122 may allow a greater contact surface for the foot 120 to make contact with the ground or surface that the litter 100 is placed upon. In some embodiments, as illustrated in FIG. 4C the perimeter may have a greater slope closer to the exterior and internal contact points, and the slope may become shallower as the perimeter approaches the apex point 126.

The foot may be formed wherein a portion of the perimeter is parallel to the attachment surface between two apex points. In some embodiments, the foot 120 may include a flat portion 127*c* of the perimeter. In such embodiments, the exterior portion 127*a* may extend between the exterior contact point 124*a* and an exterior apex point 126*a*, and the interior portion 127*b* may extend between the interior contact point 124*b* and an interior apex point 126*b*. The apex portion 127*c* may extend between the exterior apex point 126*a* and the interior apex point 126*b*, thereby defining a flat surface.

The exterior portion 127*a* may be a curved surface, descending below the exterior contact point 124*a* and the attachment surface 125 towards the middle space 108 between the spreader bars. In some embodiments, a plane 137 may extend between the center point 128 and the exterior apex point. The plane 137 may form an exterior angle $\theta_1$ with the attachment surface 125. The exterior angle $\theta_1$ may be between 5 and 120 degrees, between 30 and 100 degrees, and between 50 and 90 degrees. In some embodiments, the foot 120 may be symmetrical about the center point 128, wherein the exterior portion 127*a* and interior portion 127*b* maintain the same radius of curvature between the respective contact point and apex point.

The attachment surface 125 may have a length, extending from the exterior contact point 124*a* to the internal contact point 124*b*. In some embodiments, the length of the apex portion 127*c* may be a quarter of the length of the attachment surface, a third of the length or up to half the length of the attachment surface 125. In some embodiments, the apex portion 127*c* may be centered above the attachment surface about the center point 126. In other embodiments, the exterior apex point 126*a* may be vertically aligned with the center point 128, and the interior apex point 126*b* may be more closely vertically aligned with the interior contact point 124*b*. In some embodiments, the interior apex point 126*b* may be vertically aligned with the interior contact point 124*b* while the exterior apex point 126*a* is vertically aligned with the center point 128.

FIG. 5A illustrates an example cross-section of a foot 120. The foot 120 includes a curved exterior portion 127*a* of the perimeter extending from the first contact point 124*a* to the first apex point 126*a*. The perimeter 127 further includes a curved interior portion 127*b* symmetrical to the exterior portion 127*a* extending from the interior contact point 124*b* to the interior apex point 126*b*. The perimeter includes an apex portion 127*c* extending between the exterior apex point 126*a* and the interior apex point 126*b*. The apex portion 127*c* may have a length that is up to a quarter of the length of the attachment surface 125, or up to a third of the length of the attachment surface 125. In some embodiments, as illustrated in FIG. 5A, the exterior and interior apex points are evenly spaced from the center point 128 (e.g., the apex portion 127*c* is centered about the center point 128).

In some embodiments, as illustrated in FIG. 5B, the interior portion 127*b* may be linear. The interior portion 127*b* may extend such that the interior contact point 124*b* and the interior apex point 126*b* are vertically aligned. In some embodiments, the length of the apex portion 127*c* may be equal to the length of the attachment surface extending between the center point 128 and the interior contact point 124*b*. In some embodiments, the interior portion 127*b* may be vertical between the interior apex point 126*b* and the interior contact point 124*b*, while in some embodiments, the interior portion 127*b*, may be slanted, such that the interior contact point 124*b* is not vertically aligned with the interior apex point 126*b*, as illustrated in FIG. 5C. The interior portion 127*b* may define an interior length, and the exterior portion 127*a* may define an exterior length. In some embodiments, the interior length may be shorter than the exterior length, equal to the exterior length or greater than the exterior length.

In some embodiments, the spreader bar arms 112, 114 may be fixed on the exterior end 112*a*, 114*a* to an attachment feature 109. As illustrated in FIG. 6A, the attachment feature 109 may surround each primary telescoping rod 105*a* of the frame rails. The attachment feature 109 may be on the opposite side of primary telescoping rod 105 relative to the connection mechanism 107. The attachment feature 109 may define an exterior surface 109*a* such that the exterior surface of the attachment feature 109 is vertically aligned with the exterior end 112*a*, 114*a* of each spreader bar arm, and the exterior contact point 124*a* of each foot, thereby defining a vertical plane which transitions into the curved surface 122 of the foot.

The attachment feature 109 may be secured by a fixing mechanism 134, for example, a screw, wherein the fixing mechanism 134 allows for the arm 112, 114 of the spreader bar 110 to rotate about the connection point 146. In some embodiments, a screw may be used to rotatably secure a bottom surface 136 of the attachment feature to a top surface of the arms 112, 114. In other embodiments, a hinge, or rotatable bond may be used.

The attachment feature 109 may further engage with the telescoping frame rails, to prevent or allow telescoping. In some embodiments, as illustrated in FIG. 6B, the attachment feature 109 may include a locking piece defining a pin end 130*a* and a lever end 130*b*. The attachment feature 109 may define a channel 138 to receive the frame rails. In some embodiments, the locking piece 130 may be disposed within the attachment feature 109 such that the locking pin 130*a* may be partially disposed through a portion of the channel wall 138*a* such that the locking pin 130*a* is moveable within the channel wall 138*a* and able to contact the frame rails.

In the extended configuration, the locking pin 130*a* may engage with a locking channel 132 disposed on the frame rail 105. In some embodiments, the locking channel 132 may be formed as a ring about the exterior circumference of the frame rail 105, wherein the ring has a thinner wall frame rail wall than other portions of the frame rail. In other embodiments, the locking channel 132 may be sized to accept the locking pin 130*a* through a portion of the frame rail. As illustrated in FIG. 6C, the locking pin 130*a* is engaged with the locking channel 132. The locking piece 130 may be biased to engage the locking channel 132. For example, when the telescoping frame rails 105 are moved from the collapsed configuration to the extended configuration, the locking pin 130*a* of the locking piece 130 will engage the locking channel 132 automatically upon extension. To disengage the locking piece 130, and thereby collapse the litter, the locking lever 130*b* may be pressed to disengage the locking pin 130*a* from the locking channel 132, and the secondary frame rail 105*b* may be telescoped into the primary frame rail 105*a*. Once the locking channel 132 is receded into the primary frame rail 105*a* the locking lever 130*b* may be released.

In some embodiments, the locking piece 130 may be on the internal side 105*e* of the frame rails, and in other embodiments the locking piece 130 may be on the exterior side 105*d* of the frame rails. In some embodiments, the locking piece 130 is disposed within the attachment feature 109 such that the locking lever 130*b* is facing the connection mechanism 107, while in other embodiments, the locking lever 130*b* is facing away from the connection mechanism 107.

As illustrated in FIG. 6D, the locking piece 130 may be disengaged from the locking channel 132, and each of the telescoping portions may be telescoped within one another. Upon collapsing, the locking pin 130*a* may rest on the exterior surface 105*d* of the secondary telescoping rod 105*b*.

The tertiary telescoping rod 105*c* may also include a locking mechanism to hold the segment in the extended configuration. As illustrated in FIG. 6E, the tertiary telescoping rod 105*c* may include a pin button 140 configured to extend through the primary telescoping rod 105*a* and secondary telescoping rod 105*b* in the collapsed configuration and extend through the secondary telescoping rod 105*b* in the extended configuration. In some embodiments, the tertiary telescoping rod 105*c* may be maintained within the secondary telescoping rod 105*b* with an exterior pin button, such that to collapse the tertiary telescoping rod 105*c* into the secondary telescoping rod 105*b*, the pin button must be disengaged from the extended configuration receiving hole 142, and recessed into the secondary telescoping rod until engaging with the collapsed configuration receiving hole 144, as illustrated in FIG. 6F.

The pin button may be biased to the engaged positions. In some embodiments, the engaged position is when the pin button 140 is engaged with either receiving hole 142, 144. In some embodiments, the disengaged position is when the pin button 140 is within the telescoping rods, transitioning between the two receiving holes. In some embodiments, the pin button 140 may be disengaged by pressing the pin into the receiving hole, and shifting the tertiary rod 105*c* to either the extended or collapsed configuration, wherein the pin button 140 will engage with one of the receiving holes 142, 144.

The litter may be configured to transition, when maneuvered, between an extended configuration and a collapsed configuration. FIGS. 7A-E illustrate a portion of the frame rail transitioning from the extended configuration FIG. 7A to the collapsed configuration FIG. 7E. In some embodiments, the litter may be configured to be deployed from the extended configuration to the collapsed configuration by a single person. Similarly, the litter may be configured to be deployed, from the collapsed configuration to the extended configuration by a single person. In the extended configuration, the frame rails 105' are extended such that the tertiary telescoping rod 105*c'* is extended from the secondary telescoping rod 105*b'*, which is then extended out of the primary telescoping rod 105*a'*. The secondary telescoping rod is secured in place by a locking mechanism, described herein, to prevent unintentional collapsing of the rail 105'. To collapse the frame, the coupler may be pushed towards the hinge side of the primary telescoping rod 105*a'*, so the spreader bar arm being to rotate about the contact point with the spacer, and the contact point with the frame rail 105'.

The spreader bar arms may rotate up to 90 degrees with respect to the coupler transitioning between being parallel with to being perpendicular to the coupler. In some embodiments, the spreader bar arms may maintain an angle between the first arm and the second arm of the respective spreader bars. Each spreader bar arm may also rotate about a connection point on the frame rails up to 90 degrees, wherein as the spreader bars rotate, the frame rails are moved closer together such that the middle space 108 shrinks. Each arm may be parallel to or substantially parallel to the frame rail in the collapsed configuration. The feet 120 may be fixed to the arms of the spreader bar, such that the attachment surface 125, and the curved surface 122 rotate with each respective arm of the spreader bar.

As the spreader bar is transitioning, the locking piece 130 and pin button may be disengaged, and the tertiary telescoping rod 105*c*' may be inserted into the middle section, and the secondary telescoping rod 105*b*' may be inserted into the primary telescoping rod 105*a*'. An example collapsed portion 100' is shown in FIG. 7E. As illustrated, in some embodiments, the coupler 115 may be perpendicular to each of the frame rails 105. Each arm of the spreader bar may be in a parallel plane to the frame rails, and in some embodiments, the exterior side of the arm may be parallel to the exterior side of the frame rail, while in other embodiments the exterior side of the arm may not be parallel to the exterior side of the frame rail. It should be noted that although the transition is described, many of the steps are interchangeable and/or able to be performed at the same time.

FIG. 8A illustrates an example litter 100 in the collapsed configuration. In the collapsed configuration, each connection mechanism 107 is released and the hinge 107*a* transitions from a closed configuration to an open configuration. Each of the frame rails is rotated about the hinge such that each of the couplers 115 are adjacent, and in some embodiments, in contact with one another. In the collapsed configuration, the feet corresponding to each frame rail (e.g., left frame rail and right frame rail) are aligned. In some embodiments, the feet disposed on the right frame rail are abutting one another at the apex points, and the internal contact point and the exterior contact point are vertically aligned.

FIG. 8B illustrates a perspective view of the example litter 100 in the collapsed configuration. In the collapsed configuration each of the collapsed spreader bars 110 are parallel to the collapsed frame rail. In some embodiments, the spreader bar 110 is spaced apart from the frame rail by the attachment feature 109 about each base section of the frame rail. In some embodiments, the space between the spreader bars 110 and the frame rail 105 may hold the fabric 150 of the litter 100.

An example litter may be rotated along the curved surfaces of the feet adjacent the exterior surface of a frame rail (e.g., the left rail or the right rail). As illustrated in FIG. 9A, in use, the litter 200 is extended to the extended configuration. Once the litter 200 is extended, the litter may be rotated about the feet below the right (or left) frame rail 205. The litter 200 may rotate on the curved surface 222 of the feet 220 such that the litter is supported on the exterior side of the frame rail 205, attachment feature 209 and feet 220. In some embodiments, the litter is not completely vertical, but the litter may be substantially vertical, or even rotated slightly to receive a person. As illustrated, the litter is rotated clockwise from the resting position to the standing position (although counterclockwise is also contemplated).

Once in the rotated position, as illustrated in FIG. 9B, the litter 200 may be moved such that the carrying structure 250 is in contact with the posterior of the person, as illustrated in FIG. 9C. The litter 200 may then be rotated back (e.g., counterclockwise) to the ground along the curved surface 222 of the feet 220 allowing for a smooth transition to the ground position as illustrated in FIG. 9E.

Example Flowchart(s) and Operations

Some embodiments of the present invention provide methods, apparatus, and computer program products related to the presentation of information according to various embodiments described herein. Various examples of the operations performed in accordance with embodiments of the present invention will now be provided with reference to FIGS. 10-11. Notably, various operations may be performed with various example embodiments described herein.

FIG. 10 illustrates a flow chart according to an example method 300 of extending and using a collapsible telescoping litter such as described herein. The method of using the litter depicted in FIG. 10 may include extending the litter from a collapsed configuration to an extended configuration at operation 310. In some embodiments, the litter may be configured to be deployed by a single person. The method 300 may continue by maneuvering the litter to be placed under the person at operation 320. Maneuvering the litter and the person may include rotating the litter about the feet such that a set of feet along a frame rail are in contact with the ground when the litter contacts the person. The method 300 may continue by rotating the litter about the curved surfaces of the feet at operation 330. The litter may be rotated such that the fabric of the litter remains in contact with the person throughout the rotation. Accordingly, an injured or incapacitated person is able to be placed onto a litter with minimal movement or discomfort.

FIG. 11 illustrates a flow chart according to an example method 400 of manufacturing a collapsible telescoping litter such as described herein. The method of manufacture depicted in FIG. 11 may include forming a first and second frame rail at operation 410. In some embodiments, the first and second frame rail may be formed by rolling appropriate sheets of carbon fiber alloy into the desired shapes (e.g., the various rods), and fitting the primary, secondary, and tertiary telescoping rods together. The method may continue by forming at least one spreader bar at operation 420. The method may continue by connecting the first and second frame rails with the at least one spreader bar at operation 430. The method 400 may further continue by attaching a first and second foot to the at least one spreader bar at operation 440. The method 400 may conclude by affixing a carrying structure about each of the first and second frame rails at operation 450. Notably, additional features (e.g., attachment features, pins, etc.), such as described herein may be assembled appropriately to form the desired litter. Along these lines, additional feet and/or spreader bars, rods, etc. may also be assembled appropriately to form the desired litter. In this regard, one of ordinary skill in the art with the benefit of this disclosure could formulate a corresponding method of manufacture to provide various litter embodiments contemplated herein.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

That which is claimed:

1. A litter for carrying an injured person, the litter comprising: a pair of frame rails defining a middle space therebetween; a carrying structure supported by the pair of frame rails within the middle space and defining a top surface and a bottom surface, wherein the carrying structure is configured to support the injured person on the top surface; at least one spreader bar disposed between the pair of frame rails; and at least one foot defining a top and a bottom, wherein the top of the at least one foot is attached to a bottom side of at least one of the at least one spreader bar or at least one of the pair of frame rails, wherein each of the pair of frame rails extend along a longitudinal direction, wherein the at least one foot defines a cross-section in a cross-sectional plane perpendicular to the longitudinal direction, wherein the cross-section defines a perimeter extending, at least, from an exterior contact point with the at least one spreader bar or at least one of the pair of frame rails to an internal contact point with the at least one spreader bar or at least one of the pair of frame rails, wherein the perimeter includes an apex point, and the perimeter is curved from the exterior contact point to the apex point; wherein the at least one foot defines a curved surface leading downwardly from the top to the bottom vertically away from the top surface of the carrying structure and horizontally toward the middle space such that the litter is configured for supported rotation along the curved surface between a loading position and a flat position to aid in loading of the injured person.

2. The litter of claim 1, wherein each of the pair of frame rails defines an exterior side and an internal side, wherein the internal side of each of the pair of frame rails faces the middle space, wherein the exterior side of each of the pair of frame rails is opposite the internal side, wherein the curved surface leads downwardly from a contact point with the at least one spreader bar or at least one of the pair of frame rails, wherein the contact point vertically aligns with the exterior side of one of the pair of frame rails.

3. The litter of claim 1, wherein the at least one foot further defines an attachment surface extending along the spreader bar between the exterior contact point and the internal contact point, wherein the attachment surface is affixed to the spreader bar.

4. The litter of claim 3, wherein in the cross-sectional plane, the apex point is spaced apart from a center point of the at least one foot that is along the spreader bar between the exterior contact point and the internal contact point, such that a plane extending between the center point and the apex point defines an angle with the spreader bar that is greater than 5 degrees and less than 120 degrees.

5. The litter of claim 1, wherein the perimeter comprises an exterior portion extending from the exterior contact point to the apex point and an interior portion extending from the internal contact point to the apex point, wherein the internal portion is linear.

6. The litter of claim 1, wherein the apex point is a first apex point and the perimeter comprises a second apex point wherein the perimeter is curved from the exterior first contact point to the first apex point, and wherein the perimeter is linear between the first apex point and the second apex point.

7. The litter of claim 6, wherein the perimeter is curved between the internal contact point and the second apex point.

8. The litter of claim 1, wherein the at least one foot is attachable at a plurality of points along the length of the spreader bar.

9. The litter of claim 1, wherein each of the pair of frame rails comprises at least two telescoping rods hingedly connected.

10. The litter of claim 9, wherein each of the telescoping rods comprise an attachment feature opposite a hinge, wherein the attachment feature is configured to retain the telescoping rod in an extended position.

11. The litter of claim 9, wherein each of the at least two telescoping rods are primary telescoping rods, wherein each of the primary telescoping rods is configured to telescopingly receive a secondary telescoping rod, and wherein each secondary telescoping rod is configured to telescopingly receive a tertiary telescoping rod.

12. The litter of claim 1, wherein the at least one spreader bar has a first arm and a second arm hingedly connected, wherein each of the first arm and second arm are rotatably attached to a respective one of the pair of frame rails such that each of the first arm and the second arm are configured to rotate about the frame rails between a collapsed position and an extended position.

13. The litter of claim 12, wherein the at least one foot comprises a first foot and a second foot, wherein the first foot is attached to the first arm and the second foot is attached to the second arm.

14. The litter of claim 1, wherein the litter is constructed from carbon fiber.

15. The litter of claim 1, wherein the litter is made from carbon fiber and aluminum.

16. The litter of claim 1, wherein the carrying structure comprises a fabric secured between the pair of frame rails.

17. A litter for carrying an injured person, the litter comprising:

a pair of frame rails defining a middle space therebetween, wherein each of the pair of frame rails extend along a longitudinal direction;

a carrying structure supported by the pair of frame rails within the middle space and defining a top surface and a bottom surface, wherein the carrying structure is configured to support the injured person on the top surface;

at least one spreader bar disposed between the pair of frame rails; and at least one foot defining a top and a bottom, wherein the at least one foot defines an attachment surface, wherein the attachment surface is attached to a bottom side of the at least one spreader bar, wherein the at least one foot defines a curved surface leading downwardly from the top to the bottom vertically away from the top surface of the carrying structure and horizontally toward the middle space, wherein the at least one foot defines a cross-section in a cross-sectional plane perpendicular to the longitudinal direction, wherein the cross-section defines a perimeter extending, at least, from an exterior contact point with the at least one spreader bar to an internal contact point with the at least one spreader bar, wherein the perimeter includes an apex point, and the perimeter is curved from the exterior contact point to the apex point, wherein the attachment surface extends along the spreader bar between the exterior contact point and the internal contact point.

* * * * *